US005888694A

United States Patent [19]

Yamada et al.

[11] Patent Number: 5,888,694

[45] Date of Patent: Mar. 30, 1999

[54] SILVER HALIDE PHOTOGRAPHIC MATERIAL AND IMAGE FORMATION USING THE SAME

[75] Inventors: Kohzaburoh Yamada; Toshiaki Kubo, both of Kanagawa, Japan

[73] Assignee: Fuji Photo Film Co., Ltd., Kanagawa, Japan

[21] Appl. No.: 801,527

[22] Filed: Feb. 18, 1997

Related U.S. Application Data

[63] Continuation of Ser. No. 516,403, Aug. 17, 1995, abandoned.

[30] Foreign Application Priority Data

Aug. 19, 1994 [JP] Japan ..... 6-216709

[51] Int. Cl.[6] ..... G03C 1/06

[52] U.S. Cl. ..... 430/264; 430/598; 430/600; 430/603; 430/487

[58] Field of Search ..... 430/264, 598, 430/600, 603, 487

[56] References Cited

U.S. PATENT DOCUMENTS

| | | | |
|---|---|---|---|
| 4,471,044 | 9/1984 | Parton et al. . | |
| 4,851,321 | 7/1989 | Takagi et al. | 430/264 |
| 4,859,579 | 8/1989 | Hirano et al. | 430/600 |
| 5,015,561 | 5/1991 | Hayashi et al. | 430/598 |

FOREIGN PATENT DOCUMENTS 63-286840 11/1988 Japan .

OTHER PUBLICATIONS

"7th International Symposium on Organo–metallic Chemistry Directed towards Organic Synthesis" (Abstracts) p. 145 (Sep. 19–23, 1993).

*Primary Examiner*—Geraldine Letscher
*Attorney, Agent, or Firm*—Sughrue, Mion, Zinn, Macpeak & Seas, PLLC

[57] ABSTRACT

A silver halide photographic material is described, which comprises a compound represented by the following formula (I) or (II):

$$A\text{-}((L)_m\text{—}B)_n \quad \text{(I)}$$

$$(A\text{—}(L)_m)_n\text{-}B \quad \text{(II)}$$

wherein A represents an adsorption accelerating group to silver halide or a precursor thereof; B represents a quaternised nitrogen-containing heterocyclic ring and a counter ion thereof; L represents a linking group; m represents 0 or 1; and n represents an integer of from 1 to 4. An image formation method is also described, which comprises the steps of exposing the above-described silver halide photographic material and developing the exposed material with a specific developer.

2 Claims, 1 Drawing Sheet

SILVER HALIDE PHOTOGRAPHIC MATERIAL AND IMAGE FORMATION USING THE SAME

This is a Continuation of application Ser. No. 08/516,403, filed Aug. 17, 1995 now abandoned.

FIELD OF THE INVENTION

The present invention relates to a silver halide photographic material and a method for forming a high-contrast image using the photographic material. More particularly, the present invention relates to a silver halide photographic material having a controlled gradation.

BACKGROUND OF THE INVENTION

In the photomechanical process, an image formation system capable of ensuring ultrahigh-contrast photographic characteristics is required so as to obtain satisfactory reproduction of continuous gradation in dot images or reproduction of line images. Hitherto, a special developer called a lith developer has been used for this purpose. The lith developer contains only hydroquinone as a developing agent and in order not to inhibit its infectious developability, the developer must be used at a very low concentration of the free sulfite ion (usually, 0.1 mol/l or less) used as a formaldehyde adduct of a sulfite preservative and at a high pH (substantially, pH of 11 or more), otherwise, desirable properties cannot be obtained. Accordingly, the lith developer is extremely susceptible to air oxidation and bound to a serious defect such that it cannot endure storage over 3 days. Therefore, if the processing may be carried out using a general black-and-white developer by taking the stability of the processing as a primary matter, the stability of the developer may outstandingly be improved. However, the dot quality and the like are disadvantageously inferior to those achieved in the development with a lith developer. Further, U.S. Pat. No. 2,419,975 discloses that a high-contrast negative image can be obtained by adding a certain kind of hydrazine compound to a silver halide emulsion. However, in order to obtain a ultrahigh-contrast ($\gamma \geqq 10$) negative image using a specific example of the hydrazine compound set forth in the patent, a developer having a high pH of 12.8 must be used. The strong alkali developer having a pH near 13 is readily air oxidized and unstable and it cannot endure a long-term storage or use. Of course, if the sulfite ion content is increased, the storage ability can be improved but a large amount of sulfite must be added to sufficiently improve the stability of the developer having such a high pH, which gives rise not only to contamination of the processing solution but also a serious bad effect that the increase in image contrast is inhibited. Accordingly, an image formation system ensuring very high contrast free of the above-described defects as well as satisfactory storage ability of the processing solution has been demanded.

To meet these requirements, U.S. Pat. Nos. 4,224,401, 4,168,977, 4,166,742, 4,311,781, 4,272,606, 4,221,857 and 4,243,739 have proposed a system for forming a superhigh-contrast negative image having a $\gamma$ value exceeding 10 where a surface latent image type silver halide photographic material having added thereto a specific acylhydrazine compound is processed with a stable developer having a pH of from 11.0 to 12.3. However, this image formation system is still bound to a problem such that a superhigh-contrast image is difficultly obtained in a so-called rapid access processing (more specifically, a very rapid photographic processing allowing from 90 to 120 seconds for the total processing time from the initiation of the processing to the production of a dried film through processings, in which from 15 to 60 seconds are allotted to the development) which stands now in a great need.

On the other hand, with respect to a high-contrast silver halide emulsion, for example, British Patent 775,197 and U.S. Pat. No. 3,531,289 disclose an emulsion of grains formed by adding a rhodium salt. However, the increase in contrast due to the rhodium salt is small (according to Example 1 of the above-described U.S. patent, the contrast of 2.60 was increased only to 3.20) and the blacking density (density max) is lowered if the amount of rhodium is increased. A superhigh-contrast image as required in the silver halide photographic material for photomechanical process cannot be obtained.

SUMMARY OF THE PRESENT INVENTION

Accordingly, an object of the present invention is to provide a silver halide photographic material ensuring high-contrast photographic characteristics in negative gradation using a stable developer.

Another object of the present invention is to provide an image formation method using the above-described silver halide photographic material.

These and other objects of the present invention have been achieved by a silver halide photographic material comprising a compound represented by the following formula (I) or (II):

$$A\text{-}((L)_m\text{—}B)_n \quad \text{(I)}$$

$$(A\text{—}(L)_m)_n\text{-}B \quad \text{(II)}$$

wherein A represents an adsorption accelerating group to silver halide or a precursor thereof; B represents a quaternised nitrogen-containing heterocyclic ring and a counter ion thereof; L represents a linking group; m represents 0 or 1; and n represents an integer of from 1 to 4.

Furthermore, these and other objects of the present invention have been achieved by an image formation method comprising the steps of (a) exposing the above-described silver halide photographic material and (b) developing the exposed silver halide photographic material with a developer containing a developing agent represented by the following formula (III):

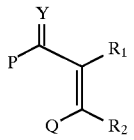

(III)

wherein $R_1$ and $R_2$ each independently represents a hydroxyl group, an amino group, an acylamino group, an alkylsulfonylamino group, an arylsulfonylamino group, an alkoxycarbonylamino group, an alkoxysulfonylamino group, a mercapto group or an alkylthio group; P and Q each independently represents a hydroxyl group, a carboxyl group, an alkoxy group, a hydroxyalkyl group, a carboxyalkyl group, a sulfo group, a sulfoalkyl group, an amino group, an aminoalkyl group, an alkyl group, an aryl group or a mercapto group, or P and Q may be bonded with each other to represent an atomic group necessary for forming a 5- to 7-membered ring together with the two vinyl carbon atoms substituted by $R_1$ and $R_2$ and the carbon atom substituted by Y; and Y represents =0 or =N—$R_3$, in which $R_3$ represents a hydrogen atom, a hydroxyl group, an alkyl group, an acyl group, a hydroxyalkyl group, a sulfoalkyl group or a carboxyalkyl group.

Moreover, these and other objects of the present invention have been achieved by an image formation method, which comprises the steps of (a) exposing the above-described silver halide photographic material comprising a compound represented by formula (I) or (II) and a hydrazine derivative and (b) developing the exposed silver halide photographic material with a developer containing a dihydroxybenzene developing agent.

Figure 1:
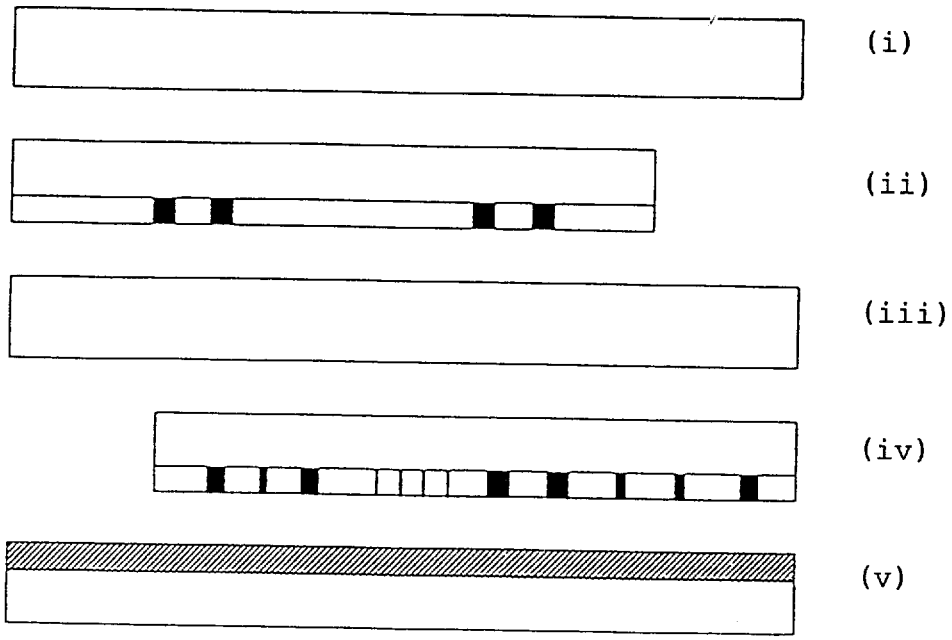
FIG. 1 shows a construction during exposure in a superimposed letter image formation by superimposition dot-to-dot working, in which each symbol indicates the following.

(i) transparent or translucent paste-in base (ii) line original (black part shows a line image)

(iii) transparent or translucent paste-in base (iv) halftone original (v) photographic material for dot-to-dot working (the slanting line part shows a light-sensitive layer).

DETAILED DESCRIPTION OF THE INVENTION

The compound represented by formula (I) or (II) for use in the present invention will be described in greater detail.

Specific examples of the adsorption accelerating group to silver halide represented by A in formula (I) or (II) include a thioamido group, a mercapto group (—SH), an aromatic or heterocyclic group having a mercapto group, a nitrogen-containing heterocyclic group containing two or more N atoms with at least one thereof being bonded to the hydrogen atom, and precursors of these groups.

Preferred examples of the group represented by A include a mercapto group (—SH), a mercaptophenyl group, a heterocyclic group having a mercapto group (e.g., 2-mercapto-1-thia-3,4-diazolyl, 2-mercaptotetrazolyl, 2-mercapto-1,3,4-triazolyl, 2-mercaptobenzoxazolyl, 2-mercaptobenzothiazolyl, 2-mercaptopyridyl, 4-mercapto-1,3,3a,7-tetrazaindenyl), a benzotriazolyl group, a thiatriazolyl group, a thioureido group (e.g., unsubstituted thioureido, N'-phenylthioureido, thioureido with both of N and N' being substituted with a linking group represented by L in formula (I) or (II)), a thiourethane group (e.g., phenylthiourethane, cyclohexylthiourethane), and a precursor of these groups.

The term "precursor" as used herein means a precursor capable of producing these groups swiftly upon processing with a developer and the precursor is preferably hydrolyzed with a hydroxide ion ($OH^-$) or a sulfite ion ($SO_3^{2-}$) contained in the developer or decomposed by the developer as triggered by a cross oxidation reaction with an imagewise generated oxidation product of the developing agent. Specific examples of the precursor in the former case include an alkoxycarbonyl group, an aryloxycarbonyl group, N,N-disubstituted carbamoyl group, an acyl group, a 1,3,3a,7-tetrazaindene-4-yl group and a uracil group represented by the following formula:

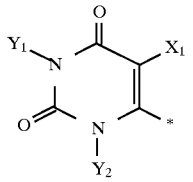

which is connected to the S atom or N atom at the * site, wherein $Y_1$, $Y_2$ and $X_1$ each represents a substituent. $Y_1$ and $Y_2$ are each preferably a substituted or unsubstituted alkyl group. $X_1$ is preferably a halogen atom, an arylthio group, an arylsulfonyl group, an arylsulfo group (an arylsulfonic acid group) or an alkoxycarbonyl group.

Examples of the latter case include groups represented by the following formula (a):

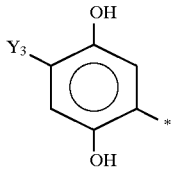

(a)

which is connected to the S atom or N atom at the * site, wherein $Y_3$ represents a substituent, preferably an N'-substituted ureido group, an acylamino group, a sulfonamido group or an alkylthio group.

The group represented by A in formula (I) or (II) is bonded to the group represented by $((L)_m—B)$ at an arbitrary position and in addition, may be substituted with one or more substituents.

The term "substituent" as used in the present invention means a halogen atom or a substituent bonded to the ring or group through a carbon atom, an oxygen atom, a nitrogen atom or a sulfur atom. Examples of the substituent bonded through a carbon atom include an alkyl group, an alkenyl group, an alkynyl group, an aryl group, a carbamoyl group, an alkoxycarbonyl group, an aryloxycarbonyl group, an acyl group, a carboxyl group, a cyano group and a heterocyclic group. Examples of the substituent bonded through an oxygen atom include a hydroxyl group, an alkoxy group, an aryloxy group, a heterocyclic oxy group, an acyloxy group, a carbamoyloxy group and a sulfonyloxy group. Examples of the substituent bonded through a nitrogen atom include an acylamino group, an amino group, an alkylamino group, an arylamino group, a heterocyclic amino group, a ureido group, a sulfamoylamino group, an alkoxycarbonylamino group, an aryloxycarbonylamino group, a sulfonamido group, an imido group and a heterocyclic group. Examples of the substituent bonded through a sulfur atom include an alkylthio group, an arylthio group, a heterocyclic thio group, a sulfamoyl group, an alkoxysulfonyl group, an aryloxysulfonyl group, a sulfonyl group, a sulfo group and sulfinyl group. These groups may be further substituted with one or more of these substituents.

The substituent will be more specifically described. Examples of the halogen atom include a fluorine atom, a chlorine atom and a bromine atom. The alkyl group includes a straight-chain, branched-chain or cyclic alkyl group having from 1 to 16, preferably from 1 to 10, carbon atoms, such as methyl, ethyl, isopropyl, t-butyl, benzyl and cyclopentyl. The alkenyl group includes an alkenyl group having from 2 to 16 carbon atoms such as vinyl, 1-propenyl, 1-hexenyl and styryl. The alkynyl group includes an alkynyl group having from 2 to 16 carbon atoms such as ethynyl, 1-butynyl, 1-dodecenyl and phenylethynyl. The aryl group includes an aryl group having from 6 to 24 carbon atoms such as phenyl, naphthyl and p-methoxyphenyl. The carbamoyl group includes a carbamoyl group having from 1 to 18 carbon atoms such as carbamoyl, N-ethylcarbamoyl, N-octylcarbamoyl and N-phenylcarbamoyl. The alkoxycarbonyl group includes an alkoxycarbonyl group having from 2 to 18 carbon atoms such as methoxycarbonyl and benzyloxycarbonyl. The aryloxycarbonyl group includes an aryloxycarbonyl group having from 7 to 18 carbon atoms such as phenoxycarbonyl. The acyl group includes an acyl group having from 1 to 18 carbon atoms such as acetyl and benzoyl. The heterocyclic group connected to the carbon atom on the ring includes a 5- or 6-membered, saturated or unsaturated heterocyclic ring having from 1 to 5 carbon atoms and containing one or more of an oxygen atom, a nitrogen atom and a sulfur atom, in which the number of the hetero atom and the kind of the element constituting the ring may be one or in a plurality, such as 2-furyl, 2-thienyl, 2-pyridyl and 2-imidazolyl.

The alkoxy group includes an alkoxy group having from 1 to 16, preferably from 1 to 10, carbon atoms such as methoxy, 2-methoxyethoxy and 2-methanesulfonylethoxy. The aryloxy group includes an aryloxy group having from 6 to 24 carbon atoms such as phenoxy, p-methoxyphenoxy and m-(3-hydroxypropionamido)phenoxy. The heterocyclic oxy group includes a 5- or 6-membered, saturated or unsaturated heterocyclic oxy group having from 1 to 5 carbon atoms and containing one or more of an oxygen atom, a nitrogen atom and a sulfur atom, in which the number of the hetero atom and the kind of the element constituting the ring may be one or in a plurality, such as 1-phenyltetrazolyl-5-oxy, 2-tetrahydropyranyloxy and 2-pyridyloxy. The acyloxy group includes an acyloxy group having from 1 to 16, preferably from 1 to 10, carbon atoms such as acetoxy, benzoyloxy and 4-hydroxybutanoyloxy. The carbamoyloxy group includes a carbamoyloxy group having from 1 to 16, preferably from 1 to 10, carbon atoms such as N,N-dimethylcarbamoyloxy, N-hexylcarbamoyloxy and N-phenylcarbamoyloxy. The sulfonyloxy group includes a sulfonyloxy group having from 1 to 16 carbon atoms such as methanesulfonyloxy and benzenesulfonyloxy.

The acylamino group includes an acylamino group having from 1 to 16, preferably from 1 to 10, carbon atoms such as acetamido and p-chlorobenzoylamido. The alkylamino group includes an alkylamino group having from 1 to 16, preferably from 1 to 10, carbon atoms such as N,N-dimethylamino and N-(2-hydroxyethyl)amino. The arylamino group includes an arylamino group having from 6 to 24 carbon atoms such as anilino and N-methylanilino. The heterocyclic amino group includes a 5- or 6-membered, saturated or unsaturated heterocyclic amino group having from 1 to 5 carbon atoms and containing one or more of an oxygen atom, a nitrogen atom and a sulfur atom, in which the number of the hetero atom and the kind of the element constituting the ring may be one or in a plurality, such as 2-oxazolylamino, 2-tetrahydropyranylamino and 4-pyridylamino. The ureido group includes a ureido group having from 1 to 16, preferably from 1 to 10, carbon atoms such as ureido, methylureido, N,N-diethylureido and 2-methanesulfonamidoethylureido.

The sulfamoylamino group includes a sulfamoylamino group having from 0 to 16, preferably from 0 to 10, carbon atoms such as methylsulfamoylamino and 2-methoxyethylsulfamoylamino. The alkoxycarbonylamino group includes an alkoxycarbonylamino group having from 2 to 16, preferably from 2 to 10, carbon atoms such as methoxycarbonylamino. The aryloxycarbonylamino group includes an aryloxycarbonylamino group having from 7 to 24 carbon atoms such as phenoxycarbonylamino and 2,6-dimethoxyphenoxycarbonylamino. The sulfonamido group includes a sulfonamido group having from 1 to 16, preferably from 1 to 10, carbon atoms such as methanesulfonamido and p-toluenesulfonamido. The imido group includes an imido group having from 4 to 16 carbon atoms such as N-succinimido and N-phthalimido. The heterocyclic group connected through the nitrogen atom of the ring is a 5- or 6-membered heterocyclic ring comprising a nitrogen atom and at least one of a carbon atom, an oxygen atom and a sulfur atom, such as pyrrolidino, morpholino and imidazolino.

The alkylthio group includes an alkylthio group having from 1 to 16, preferably from 1 to 10, carbon atoms such as methylthio and 2-phenoxyethylthio. The arylthio group includes an arylthio group having from 6 to 24 carbon atoms such as phenylthio and 2-carboxyphenylthio. The heterocyclic thio group includes a 5- or 6-membered, saturated or unsaturated heterocyclic thio group having from 1 to 5 carbon atoms and containing one or more of an oxygen atom, a nitrogen atom and a sulfur atom, in which the number of the hetero atom and the kind of the element constituting the ring may be one or in a plurality, such as 2-benzothiazolylthio and 2-pyridylthio.

The sulfamoyl group includes a sulfamoyl group having from 0 to 16, preferably from 0 to 10, carbon atoms such as sulfamoyl, methylsulfamoyl and phenylsulfamoyl. The alkoxysulfonyl group includes an alkoxysulfonyl group having from 1 to 16, preferably from 1 to 10, carbon atoms such as methoxysulfonyl. The aryloxysulfonyl group includes an aryloxysulfonyl group having from 6 to 24, preferably from 6 to 12, carbon atoms such as phenoxysulfonyl. The sulfonyl group includes a sulfonyl group having from 1 to 16, preferably from 1 to 10, carbon atoms such as methanesulfonyl and benzenesulfonyl. The sulfinyl group includes a sulfinyl group having from 1 to 16, preferably from 1 to 10, carbon atoms such as methanesulfinyl and benzenesulfinyl.

In the present invention, preferably examples of the substituent include an alkyl group, an aryl group, a carbamoyl group, an alkoxycarbonyl group, an aryloxycarbonyl group, an acyl group, a cyano group, an alkoxy group, an aryloxy group, a carbamoyloxy group, an acylamino group, a ureido group, a sulfamoylamino group, an alkoxycarbonylamino group, a sulfonamido group, a sulfamoyl group and a sulfonyl group. More preferable examples thereof include an alkyl group, an aryl group, a carbamoyl group, an alkoxy group, an acylamino group, a ureido group, a sulfonamido group and a sulfamoyl group.

In formula (I) or (II), B represents a quaternised nitrogen-containing heterocyclic group and a counter ion thereof. Specific examples of the structure in the quaternary salt moiety include a pyridinium salt, a quinolinium salt, an isoquinolinium salt, a phenanthrinium salt, a triazolinium salt, an imidazolinium salt and a benzothiazolinium salt. B also represents a bis- or tris-cationium compound resulting from bonding of a plurality of these quaternary salts and counter ions thereof and in this case, respective quaternary salts may be the same or different and are connected through a linking group.

The group represented by B in formula (I) or (II) may be connected to the group represented by $((L)_m—A)$ at any position and also may be substituted with any substituent other than this group.

However, when the substituent bonding to the nitrogen atom of the nitrogen-containing heterocyclic ring to form a quaternary salt or the substituent bonded to the carbon atom adjacent to the nitrogen atom is an alkyl group, the alkyl group does not have an alkynyl group at the α-position or a carbonyl group, a hydrazino group or an imino group at the β-position.

This is because if the quaternised nitrogen-containing heterocyclic group represented by B has such a substituent, the resulting compound has a function to non-imagewise fog unexposed silver halide as described in JP-A-62-291637 and show disadvantageous properties to the purposes of the present invention.

Examples of the substituent represented by B are the same as the substituents described above for use in the present invention and the preferred examples thereof are also the same as those enumerated in the above-described substituents.

The group represented by B in formula (I) or (II) is preferably represented by the following formula (b), (c) or (d):

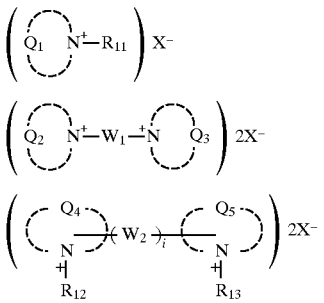

(b)

(c)

(d)

wherein $Q_1$, $Q_2$, $Q_3$, $Q_4$ and $Q_5$ each represents a nonmetallic atomic group necessary for forming a nitrogen-containing heterocyclic ring together with the nitrogen atom; $R_{11}$, $R_{12}$ and $R_{13}$ each represents a substituent capable of bonding the quaternised nitrogen atom; $W_1$ and $W_2$ each represents a linking group; i represents 0 or 1; $X^-$ represents a counter anion; and $Q_2$ and $Q_3$, $Q_4$ and $Q_5$, or $R_{12}$ and $R_{13}$ may be the same or different.

Specific examples of the quaternised nitrogen-containing heterocyclic ring formed by $Q_1$, $Q_2$, $Q_3$, $Q_4$ or $Q_5$ together with the nitrogen atom and preferred examples thereof are the same as the specific examples described above for B in formula (I) or (II).

The structure of the quaternary salt formed by $Q_1$, $Q_2$, $Q_3$, $Q_4$ or $Q_5$ together with the nitrogen atom is particularly preferably a pyridinium salt, an isoquinolinium salt or a quinolinium salt, most preferably a pyridinium salt.

The group represented by formula (b), (c) or (d) may be connected to the group represented by $((L)_m—A)$ at any position and also may be substituted with any substituent other than this group.

However, when the substituent is bonded to the carbon atom adjacent to the quaternary nitrogen atom or when the substituent represented by $R_{11}$, $R_{12}$ or $R_{13}$ represents an alkyl group, the alkyl group does not have an alkynyl group at the α-position or a carbonyl group, a hydrazino group or an imino group at the β-position.

Preferred examples of $R_{11}$, $R_{12}$ or $R_{13}$ include an alkyl group, an aryl group and a heterocyclic group exclusive of the above-described limitation and particularly preferably a substituted or unsubstituted alkyl group exclusive of the above-described limitation.

When $R_{11}$, $R_{12}$ and $R_{13}$ each represents an alkyl group, the alkyl group includes a straight-chain, branched-chain or cyclic alkyl group having from 1 to 16, preferably from 1 to 10, carbon atoms such as methyl, ethyl, propyl, isopropyl, t-butyl, allyl, propargyl, 2-butenyl, 2-hydroxyethyl, benzyl, phenamyl, 4-methylbenzyl, 2-methanesulfonamidoethyl, 2-methanesulfonylethyl, 2-methoxyethyl, cyclopentyl and 2-acetamidoethyl.

The counter ion is now described below.

The counter ion is a counter ion for charge balance and is an anion or when two or more anionic groups are present in the molecule, it is a cation. Examples of the anion include a chlorine ion, a bromine ion, a iodine ion, a p-toluenesulfonic acid ion, a sulfuric acid ion, a perchlorine ion, a trifluoromethanesulfonic acid ion, a boron tetrafluoride ion and a phosphorus hexafluoride ion. Examples of the cation include a sodium ion, a potassium ion, a lithium ion, a calcium ion, an ammonium ion, a tetrabutylammonium ion and a triethylammonium ion. If an inner salt is formed, no counter ion is present.

The linking group represented by L in formula (I) or (II) is a divalent or trivalent linking group and connects A with B, two A groups with B, or A with two B groups.

The divalent linking group is an atom or an atomic group containing at least one of C, N, S and O. Specific examples thereof include an alkylene group, an alkenylene group, an alkynylene group, an arylene group —O—, —S—, —NH—, —N═, —CO— and $—SO_2—$ (these groups may have one or more substituents), which may be used individually or in combination.

Preferred examples of the combination thereof include —COO—, —CONH—, $—SO_2NH—$, —OCONH—, —NHCONH—, $NHSO_2NH—$, -(alkylene)-CONH—, -(arylene)-$SO_2NH$—, —COO-(alkylene)-, —CONH-(alkylene)-, —$SO_2NH$-(alkylene)-, —NHCONH-(alkylene)-, —CO-(alkylene)-, —O-(alkylene)-, -(alkylene)-NHCONH— and —S-(alkylene)-.

Examples of the trivalent linking group include a trisubstituted ureido group, a trisubstituted amino group, a trisubstituted methine group, a disubstituted carbamoyl group, a disubstituted urethane group, a disubstituted sulfamoyl group and a disubstituted sulfamoylamino group, and among these, particularly preferred are a trisubstituted ureido group, a disubstituted carbamoyl group and a disubstituted sulfamoyl group.

In formula (I) or (II), m represents 0 or 1 and n represents an integer of from 1 to 4 and particularly preferably, m represents 0 or 1 and n represents 1 or 2.

Specific examples of the compound of the present invention are set forth below, but the present invention is by no means limited to these.

$[A - L - B] \cdot {}_nX^{\ominus}$
| No. | A | L | B | ${}_nX^{\ominus}$ |
|---|---|---|---|---|
| I-1 | 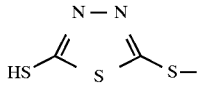 | $-CH_2-$ | 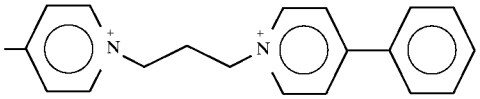 | $2Br^-$ |
| I-2 | " | $\leftarrow CH_2 \rightarrow_3$ | 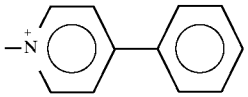 | $Cl^-$ |
| I-3 | " | $\leftarrow CH_2 \rightarrow_8$ | 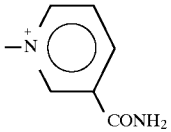 | $Cl^-$ |
| I-4 | " | $\leftarrow C_2H_4O \rightarrow_2 C_2H_4-$ | 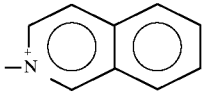 | $Cl^-$ |
| I-5 | " | $\leftarrow C_2H_4S \rightarrow_3 C_2H_4-$ | 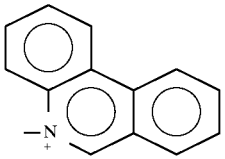 | $Br^-$ |
| I-6 | " | 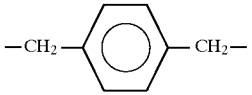 | 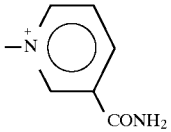 | $Cl^-$ |
| I-7 | " | $-CH_2CONH-$ | 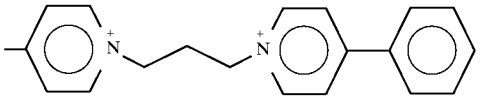 | $2Cl^-$ |

-continued
| No. | A | L | B | $_nX^{\ominus}$ |
|---|---|---|---|---|
| | | $[A-L-B]\cdot{}_nX^{\ominus}$ | | |
| I-8 | " | " | 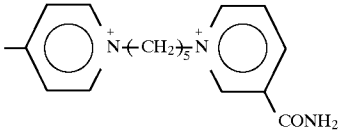 | $2Cl^-$ |
| I-9 | 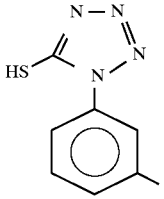 | $-NHCONH-$ | 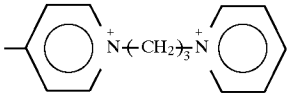 | $2Cl^-$ |
| I-10 | " | $-NHCONH-$ | 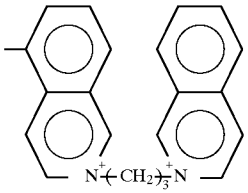 | $2Cl^-$ |
| I-11 | " | $-SO_2NH(CH_2)_3-$ | 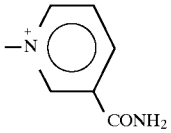 | $Cl^-$ |
| I-12 | 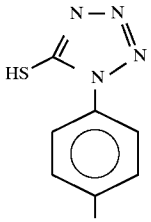 | $-SO_2NH-$ | 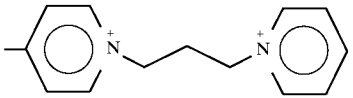 | $2Cl^-$ |
| I-13 | " | $-SO_2NH(CH_2)_8-$ | 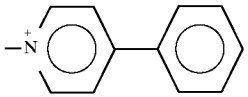 | $Cl^-$ |

-continued
| No. | A | L | B | $_nX^{\ominus}$ |
|---|---|---|---|---|
| | | $[A-L-B]\cdot{}_nX^{\ominus}$ | | |
| I-14 | " | $-NHCO(CH_2)_3-$ | 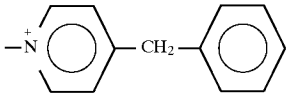 | $Cl^-$ |
| I-15 | " | $-COO(CH_2)_2-$ | 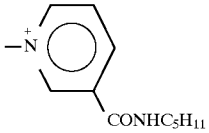 | $Cl^-$ |
| I-16 | 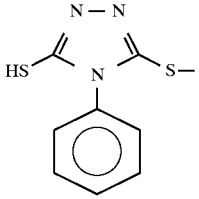 | $-(CH_2)_8-$ | 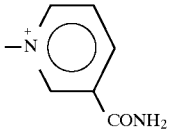 | $Cl^-$ |
| I-17 | " | $-(CH_2CH_2O)_3CH_2CH_2-$ | 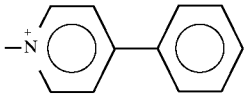 | $I^-$ |
| I-18 | 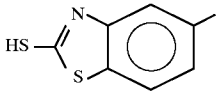 | $-NHCOCH_2-$ | 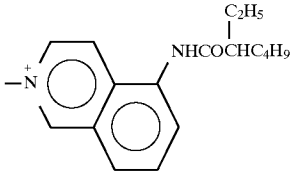 | 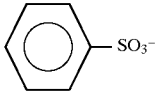 |
| I-19 | 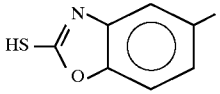 | $-SO_2NH(CH_2)_3-$ | 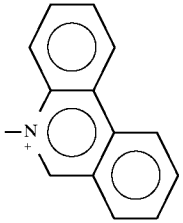 | $Cl^-$ |

-continued
| No. | A | L | B | $_nX^{\ominus}$ |
|---|---|---|---|---|
| | | $[A-L-B]\cdot{}_nX^{\ominus}$ | | |
| I-20 | 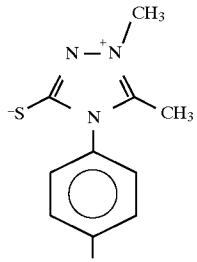 | $-SO_2NH(CH_2)_3-$ | 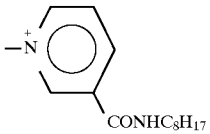 | $Cl^-$ |
| I-21 | 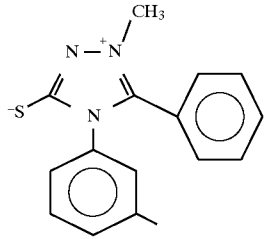 | $-NHCONH(CH_2)_3-$ | 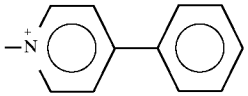 | $Br^-$ |
| I-22 | 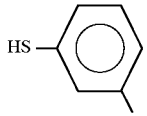 | $-NHCONH(CH_2)_2$ | 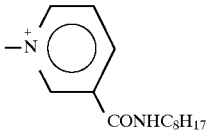 | $Cl^-$ |
| I-23 | 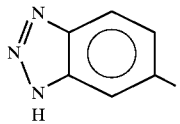 | $-NHCONH-(CH_2)_3-$ | 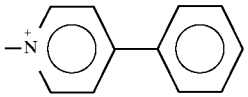 | $Cl^-$ |
| I-24 | " | $-SO_2NH(CH_2)_3$ | 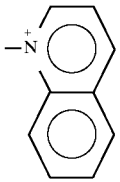 | $I^-$ |

-continued
| No. | A | L | B | $_nX^{\ominus}$ |
|---|---|---|---|---|
| | | $[A-L-B]\cdot{}_nX^{\ominus}$ | | |
| I-25 | " | $-COO(CH_2)_2-$ | 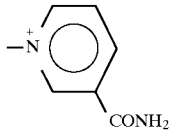 | $Cl^-$ |
| I-26 | " | $-COCH_2-$ | 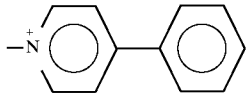 | $Cl^-$ |
| I-27 | " | 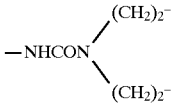 | 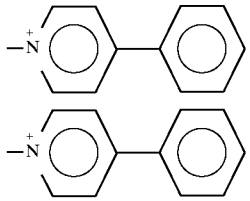 | $2Cl^-$ |
| I-28 | " | $-CH_2-NH-$ | 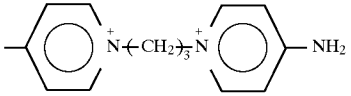 | $2Br^-$ |
| I-29 | 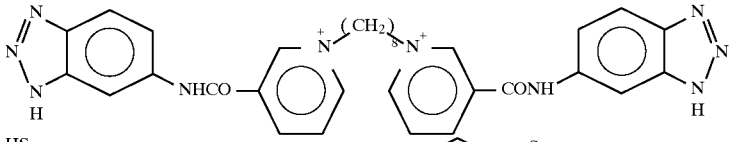 | | | $2Cl^-$ |
| I-30 | HS— | 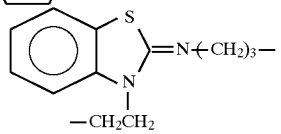 | 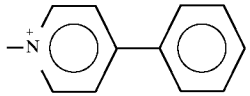 | $Cl^-$ |
| I-31 | " | " | 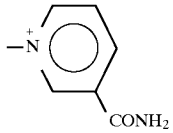 | $Br^-$ |

-continued
| No. | A | L | B | $_nX^{\ominus}$ |
|---|---|---|---|---|
| | | $[A-L-B]\cdot{}_nX^{\ominus}$ | | |
| I-32 | 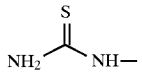 | — | 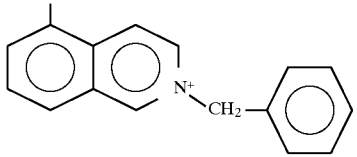 | $Cl^-$ |
| I-33 | " | $(CH_2)_3$ | 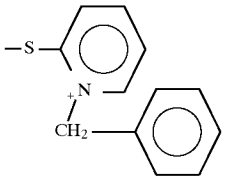 | $Br^-$ |
| I-34 | 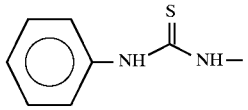 | $(CH_2)_3$ | 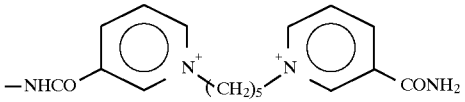 | $2Cl^-$ |
| I-35 | 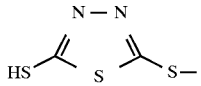 | $(CH_2)_3$ | 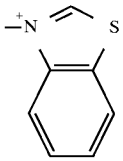 | $Cl^-$ |
| I-36 | 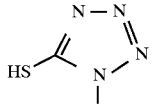 | — | 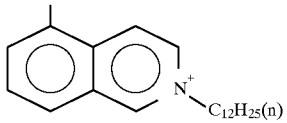 | $Cl^-$ |

-continued
| No. | A | L | B | $_nX^{\ominus}$ |
|---|---|---|---|---|
| | | $[A-L-B]\cdot{}_nX^{\ominus}$ | | |
| I-37 | 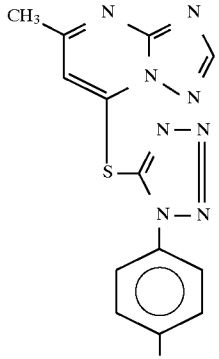 | $-SO_2NH(CH_2)_3-$ | 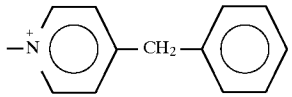 | $Cl^-$ |
| I-38 | " | $-NHCONH(CH_2)_2-$ | 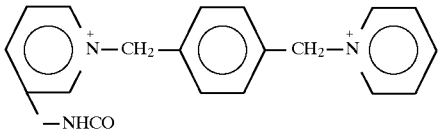 | $2Cl^-$ |
| I-39 | 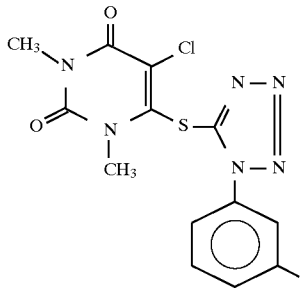 | $-COOCH_2-$ | 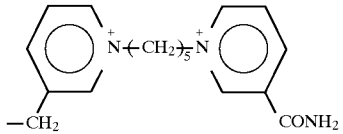 | $2TsO^-$ |

-continued
| No. | A | L | B | $_nX^{\ominus}$ |
|---|---|---|---|---|
| | | $[A-L-B]\cdot{}_nX^{\ominus}$ | | |
| I-40 | 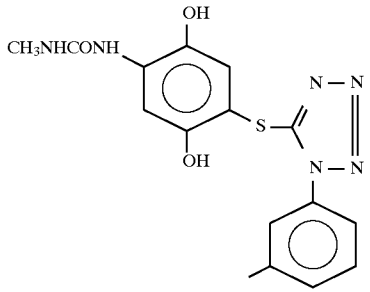 | $-SO_2NH(CH_2)_2-$ | 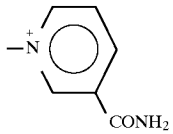 | $Cl^-$ |
| I-41 | " | $-COOCH_2-$ | 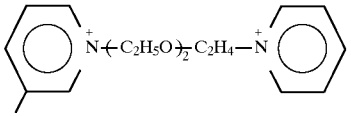 | $2Cl^-$ |
| I-42 | 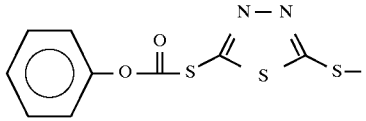 | $(CH_2)_3$ | 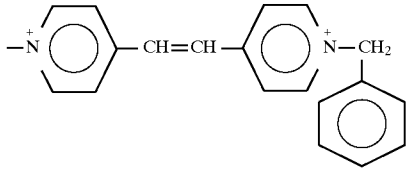 | $2Cl^-$ |
| I-43 | 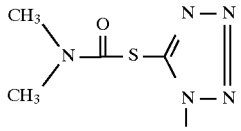 | $(CH_2)_2$ | 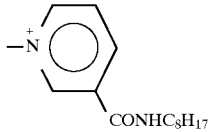 | $Br^-$ |
| I-44 | 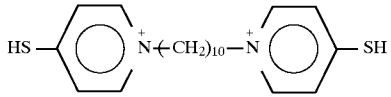 | | | $2Cl^-$ |
| I-45 | 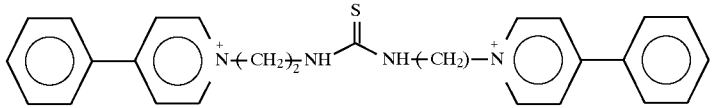 | | | $2Cl^-$ |

-continued
| No. | A | L | B | $_nX^{\ominus}$ |
|---|---|---|---|---|
| | $[A-L-B]\cdot{}_nX^{\ominus}$ | | | |
| I-46 | 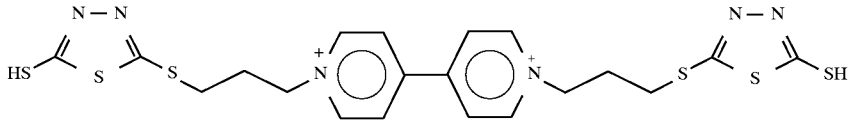 | | | $2Cl^-$ |
| I-47 | 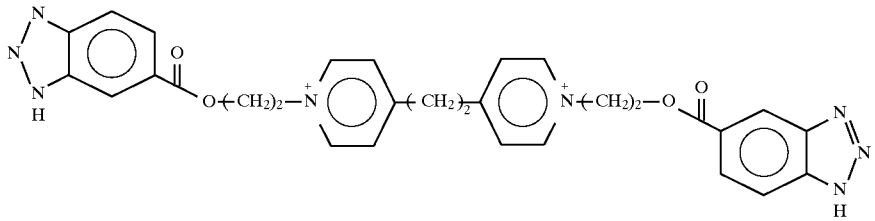 | | | $2Cl^-$ |
| I-48 | 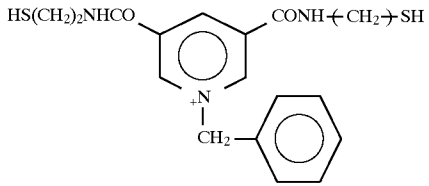 | | | $Cl^-$ |
| I-49 | 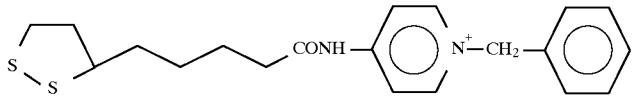 | | | $Br^-$ |
| I-50 | 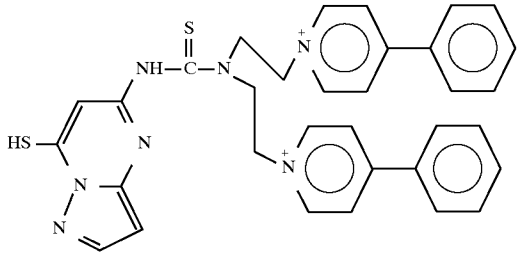 | | | $2Cl^-$ |

The compound represented by formula (I) or (II) of the present invention can be synthesized by various known methods. An optimum synthesis method is selected according to respective compounds and a general synthesis method cannot be designated, however, several useful examples of the synthesis route are described below.

Synthesis Route 1

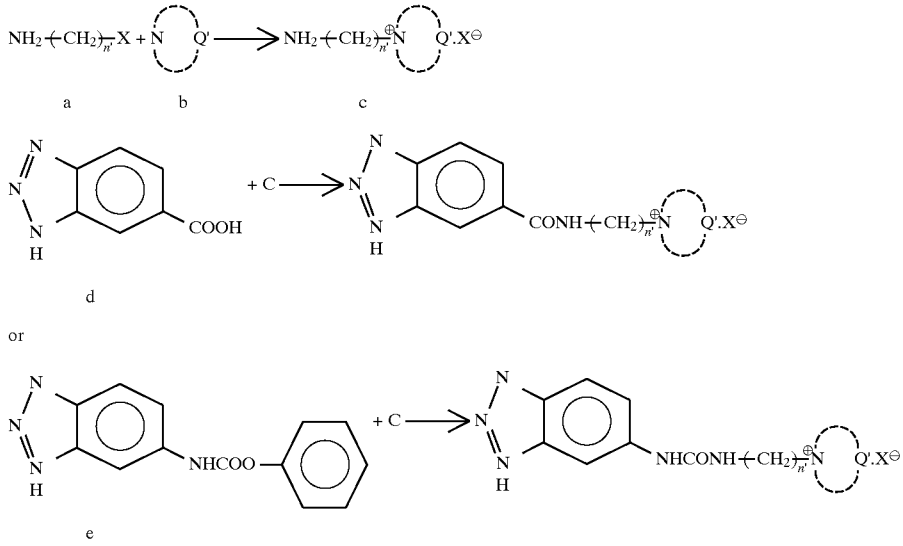

wherein X represents a halogen atom or a sulfonate such as tosylate; Q' represents a residue forming a nitrogen-containing heterocyclic ring together with N; and n' represents an integer of 1 or more. With respect to the groups d and e, various groups other than those described above may be applied to. Examples thereof include:

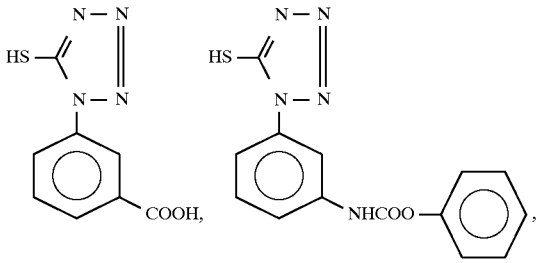

-continued

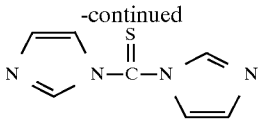

Or, in place of the group a, HO-$(CH_2)_n$-X may be used.

Synthesis Route 2

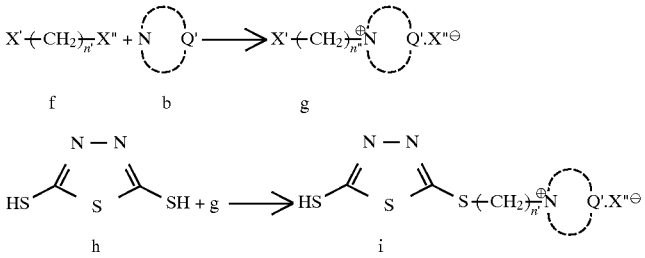

wherein X' and X" each represents a halogen atom or a sulfonate; Q' represents a residue forming a nitrogen-containing heterocyclic ring together with N; and n' represents an integer of 1 or more. With respect to the group h, various groups other than those described above may be applied to. Examples thereof include:

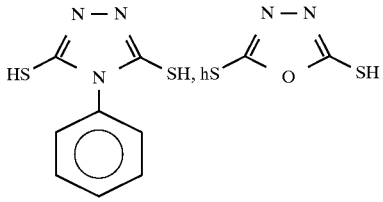

(SYNTHESIS EXAMPLES)

1. Synthesis of Compound I-2

1,3-Dichloropropane (8.7 g) and 4.0 g of 4-phenylpyridine were dissolved in 50 ml of dimethylacetamido and heated at 130° C. for 4 hours. The reaction solution was cooled to precipitate a salt. Ethyl acetate was further added thereto to increase the salt and the precipitated crystals were collected by filtration.

The resulting N-(3-chloropropyl)-4-phenylpyridinium chloride (3.63 g) and 2.14 g of 2,5-dimercapto-1,3,4-thiadiazole were suspended in acetonitrile and heated under reflux. Further, 1.2 ml of pyridine was added dropwise to the reaction solution and reacted for 3 hours. After cooling the reaction, the precipitated salt was recovered by filtration and treated with aqueous ammonia to obtain an inner salt. The resulting salt was dissolved in methanol under heating and treated by diluted hydrochloric acid to recrystallize to thereby obtain 3.2 g of Compound I-2.

2. Synthesis of Compound I-3

Compound I-3 was obtained thoroughly in the same manner as in the synthesis of Compound I-2 except for replacing 4-phenylpyridine and 1,3-dichloropropane by 3-carbamoylpyridine and 1,8-dichlorooctane, respectively.

3. Synthesis of Compound I-23

3-Chloropropylamine hydrochloride (13.0 g) and 15.5 g of 4-phenylpyridine were dissolved in dimethylacetamido and heated at 70° C. for 5 hours. Ethyl acetate was added thereto and the precipitated crystals were collected by filtration to obtain 17.5 g of 3-(4-phenylpyridyl)propylamine hydrochloride.

The resulting product was dissolved in 100 ml of dimethylacetamide together with 15.8 g of 5-phenoxycarbonylaminobenzotriazole and 12.6 g of imidazole and further, 8.7 ml of triethylamine was added thereto and heated at 60° C. for 6 hours.

Thereafter, through normal post treatment operations, 8.36 g of the objective compound was obtained.

There is no particular limitation on the addition amount of the compound represented by formula (I) or (II). However, the compound is preferably added in an amount of from $1\times10^{-5}$ to $2\times10^{-2}$ mol, more preferably from $5\times10^{-4}$ to $5\times10^{-3}$ mol, per mol of silver halide.

The compound represented by formula (I) or (II) of the present invention is incorporated into the photographic material in such a manner that if it is water soluble, an aqueous solution of the compound may be added to a silver halide solution or a hydrophilic colloid solution, and if it is water insoluble, a solution of an organic solvent miscible with water such as alcohol (e.g., methanol, ethanol), ester (e.g., ethyl acetate) or ketone (e.g., acetone) may be added thereto.

In the present invention, in incorporating the compound of formula (I) or (II) into a photographic material, it is preferably incorporated into a silver halide emulsion layer but it may also be incorporated into a light-insensitive hydrophilic colloidal layer (e.g., protective layer, interlayer, filter layer, antihalation layer) other than the silver halide emulsion layer. When the compound is added to a silver halide emulsion layer, it may be added at any stage from the initiation of chemical ripening prior to the coating of the emulsion but it is preferably added between after the completion of chemical ripening and prior to the coating of the emulsion. In particular, the compound is preferably added to the coating solution prepared for the coating.

If the silver halide photographic material containing the compound represented by formula (I) or (II) of the present invention does not contain a hydrazine derivative as a nucleating agent, the photographic material is most preferably processed with a developer containing a developing agent represented by formula (III). When the photographic material is processed with such a developer, the compound represented by formula (I) or (II) of the present invention acts by itself as a nucleating agent to provide a high-contrast image. Here, JP-A-5-53231 discloses that a quaternary salt compound of a nitrogen-containing heterocyclic ring provides high-contrast photographic properties. However, the contrast-increasing effect owing to the compound represented by formula (I) or (II) of the present invention is higher by far than that of the compound described in the above publication, because the compound of the present invention has a structure such that the adsorption accelerator to silver halide represented by A is connected to the quaternised nitrogen-containing heterocyclic group via a linking group represented by L.

Further, when the silver halide photographic material containing the compound represented by formula (I) or (II) of the present invention contains a hydrazine derivative at the same time, the photographic material may be processed either with a developer containing a developing agent represented by formula (III) or with a developer containing a dihydroxybenzene-based developing agent as a main developing agent (particularly, a developer containing a combination of a dihydroxybenzene developing agent with 1-phenyl-3-pyrazolidone or a developer containing a combination of a dihydroxybenzene developing agent and p-aminophenol).

If the former developer is used, the compound represented by formula (I) or (II) of the present invention acts as a nucleating agent and also as a nucleation accelerator and as a result, ultrahigh-contrast photographic properties higher than those in the case of using a conventionally known quaternary salt heterocyclic compound can be obtained.

If the latter developer is used, the compound represented by formula (I) or (II) of the present invention acts as a nucleation accelerator having higher activity than that of conventionally known quaternary salt heterocyclic compounds and ultrahigh-contrast photographic properties can be obtained.

The compound represented by formula (III) is now described below in detail.

In formula (III), $R_1$ and $R_2$ are the same or different and each represents a hydroxyl group, an amino group (which may be substituted with one or more alkyl groups having from 1 to 10 carbon atoms, such as methyl, ethyl, n-butyl and hydroxyethyl), an acylamino group (e.g., acetylamino, benzoylamino), an alkylsulfonylamino group (e.g., methanesulfonylamino), an arylsulfonylamino group (e.g., benzenesulfonylamino, p-toluenesulfonylamino), an alkoxysulfonylamino group (e.g., methoxysulfonylamino), an alkoxycarbonylamino group (e.g., methoxycarbonylamino), a mercapto group, or an alkylthio group (e.g., methylthio, ethylthio). $R_1$ and $R_2$ are each preferably a hydroxyl group, an amino group, an alkylsulfonylamino group or an arylsulfonylamino group.

P and Q are the same or different and each represents a hydroxyl group, a hydroxyalkyl group, a carboxyl group, a carboxyalkyl group, a sulfo group, a sulfoalkyl group, an amino group, an aminoalkyl group, an alkyl group, an alkoxy group, an aryl group or a mercapto group, or P and Q represent an atomic group capable of forming a 5- to 7-membered ring by combined with each other and further by associating with two vinyl carbons to which $R_1$ and $R_2$ are attached respectively and one carbon atom to which Y is attached. Examples of the ring formed include those completed by combining moieties chosen from —O—, —C($R_4$)($R_5$)—, —C($R_6$)=, —C(=O)—, —N($R_7$)— and —N=. $R_4$, $R_5$, $R_6$ and $R_7$ each represents a hydrogen atom, an alkyl group having from 1 to 10 carbon atoms, which may be substituted with one or more substituents (e.g., hydroxyl, carboxyl, sulfo), a hydroxyl group or a carboxyl group. Further, the 5- to 7-membered ring may be fused together with a saturated or unsaturated ring to form a condensed ring.

Specific examples of the 5- to 7-membered ring include a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring and a uracil ring. Preferred examples of the 5- to 7-membered rings include a dihydrofuranone ring, a cyclopentenone ring, a cyclohexenone ring, a pyrazolinone ring, an azacyclohexenone ring and a uracil ring.

Y represents =O or =N—$R_3$, wherein $R_3$ represents a hydrogen atom, a hydroxyl group, an alkyl group (e.g., methyl, ethyl), an acyl group (e.g., acetyl), a hydroxyalkyl group (e.g., hydroxymethyl, hydroxyethyl), a sulfoalkyl group (e.g., sulfomethyl, sulfoethyl) or a carboxyalkyl group (e.g., carboxymethyl, carboxyethyl).

Specific examples of the compounds represented by formula (III) are illustrated below. However, the invention should not be construed as being limited to these examples.

III-1

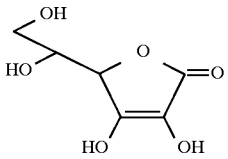

III-2

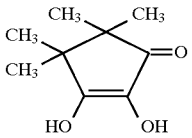

III-3

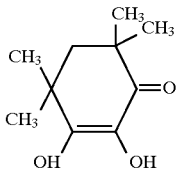

III-4

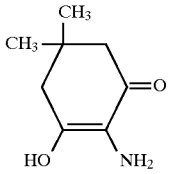

III-5

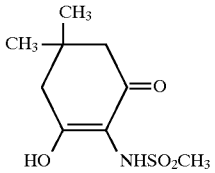

-continued

III-6

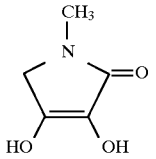

III-7

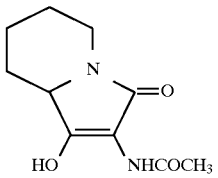

III-8

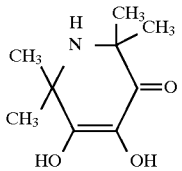

III-9

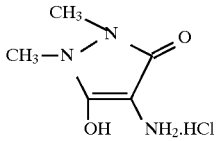

III-10

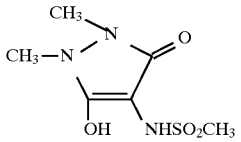

III-11

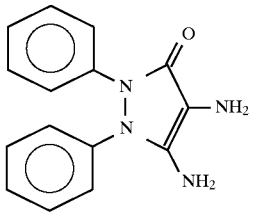

III-12

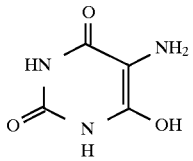

III-13

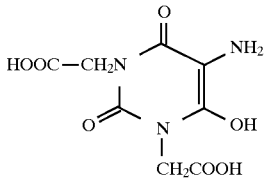

III-14

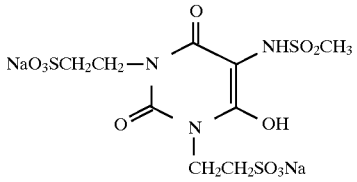

-continued

III-15

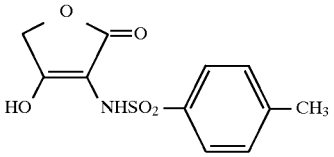

III-16

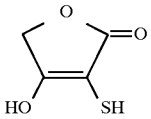

III-17

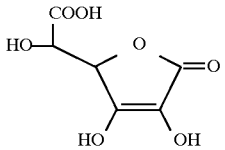

III-18

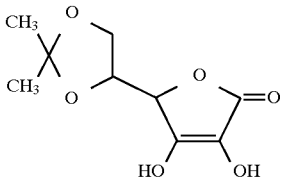

III-19

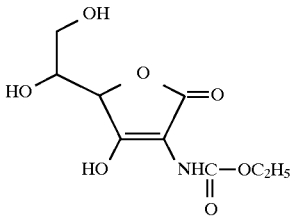

III-20

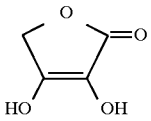

III-21

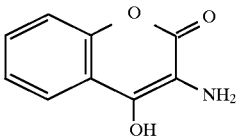

III-22

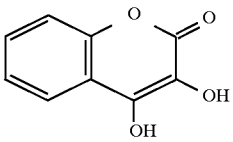

III-23

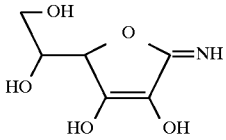

III-24

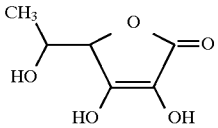

-continued

III-25

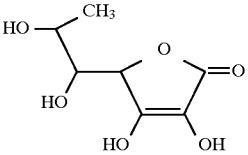

III-26

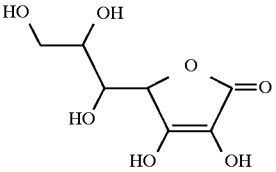

III-27

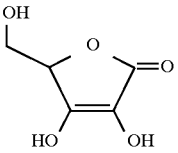

III-28

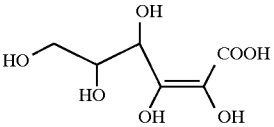

III-29

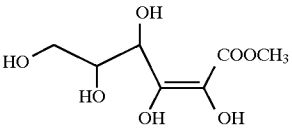

III-30

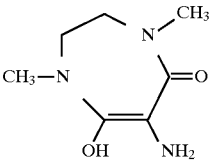

III-31

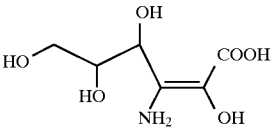

Of these compounds, ascorbic acid and erythrorbic acid (stereoisomer of ascorbic acid) are preferred.

The compound represented by formula (III) is generally used in an amount of from $5\times10^{-3}$ to 1 mol, more preferably from $10^{-2}$ to 0.5 mol, per liter of the developer.

An auxiliary developing agent may be added to the developer containing the compound represented by formula (III) for use in the present invention.

Examples of the auxiliary developing agent include dihydroxybenzenes (e.g., hydroquinone, chlorohydroquinone, bromohydroquinone, isopropylhydroquinone, methylhydroquinone, 2,3-dichlorohydroquinone, 2,3-dibromohydroquinone, 2,5-dimethylhydroquinone, potassium hydroquinone monosulfonate, sodium hydroquinone monosulfonate, catechol, pyrazol), 3-pyrazolidones (e.g., 1-phenyl-3-pyrazolidone, 1-phenyl-4-methyl-3-pyrazolidone, 1-phenyl-5-methyl-3-pyrazolidone, 1-phenyl-4-ethyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1,5-diphenyl-3-pyrazolidone, 1-p-tolyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone, 3-acetoxy-1-phenyl-3-pyrazolidone), 3-aminopyrazolines (e.g., 1-(p-hydroxyphenyl)-3-aminopyrazoline, 1-(p-methylaminophenyl)-3-aminopyrazoline, 1-(p-amino-m-methylphenyl)-3-aminopyrazoline), and phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline).

Furthermore, aminophenols can be used as an auxiliary developing agent to obtain a high-contrast image. Examples thereof include 4-aminophenol, 4-amino-3-methylphenol, 4-(N-methyl)aminophenol, 2,4-diaminophenol, N-(4-hydroxyphenyl)glycine, N-(2'-hydroxyethyl)-2-aminophenol, 2-hydroxymethyl-4-aminophenol, and 2-hydroxymethyl-4-(N-methyl)aminophenol; hydrochlorides thereof; and sulfates thereof.

The developer containing the compound represented by formula (III) as a developing agent preferably contains an auxiliary developing agent. The developer more preferably contains a p-aminophenol auxiliary developing agent and/or a 1-phenyl-3-pyrazolidone auxiliary developing agent. The auxiliary developing agent is used in an amount of from $5\times10^{-4}$ to 0.5 mol, preferably from $10^{-3}$ to 0.1 mol, per liter of the developer.

Examples of the dihydroxybenzenes for use in the developer containing a dihydroxybenzene developing agent as a main developing agent include those enumerated above. The developer preferably contains an auxiliary developing agent. Particularly, a developer containing a dihydroxybenzene developing agent and a 1-phenyl-3-pyrazolidone compound in combination and a developer containing a dihydroxybenzene developing agent and a p-aminophenol compound are preferred. Examples of the 1-phenyl-3-pyrazolidone and p-aminophenol compounds include those enumerated above. The dihydroxybenzene developing agent is used in an amount of from 0.05 to 0.8 mol, preferably from 0.2 to 0.6 mol, per mol of the developer. The auxiliary developing agent is used in an amount of 0.06 mol or less, preferably from $10^{-5}$ to 0.03 mol, per mol of the developer.

The developer containing a dihydroxybenzene developing agent as a main developing agent may contain a compound represented by formula (III) in a small amount as an antioxidant. In this case, the compound represent by formula (III) is preferably added in a concentration ratio of from 0.03 to 0.12 per the dihydroxybenzene developing agent (compound represented by formula (III)/dihydroxybenzenes).

Common components and conditions available for any developers for use in the present invention is now explained below.

The developer preferably contains a preservative agent and an alkali agent in addition to the above-described essential components. Sulfites can be used as a preservative agent. Examples of the sulfites include sodium sulfite, potassium sulfite, lithium sulfite, ammonium sulfite, sodium bisulfite, potassium bisulfite, and potassium metabisulfite. The sulfites are used in an amount of from 0.2 to 1.2 mol per liter of the developer.

Water-soluble inorganic alkali metal salts generally used (e.g., sodium hydroxide, potassium hydroxide, sodium carbonate, potassium carbonate) can be used as an alkali agent to adjust a pH.

Examples of additives other than those described above include a development inhibitor (e.g., sodium bromide, potassium bromide), an organic solvent (e.g., ethylene glycol, diethylene glycol, triethylene glycol, dimethylformamide), a development accelerator (e.g., alkanolamine such as diethanolamine and triethanolamine, imidazole, derivatives thereof), and an antifoggant or black pepper (black spot) inhibitor (e.g., mercapto compounds, imidazole compounds, benzotriazole compounds, benzimidazole compounds). Specific examples thereof include 5-nitroindazole, 5-p-nitrobenzoyl-aminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, 5-amino-1,3,4-thiadiazole-2-thiol, methylbenzotriazole, 5-methylbenzotriazole and 2-mercaptobenzotriazole. The amount added thereof such as antifoggant is preferably from 0.01 to 10 mmol, more preferably from 0.05 to 2 mmol, per liter of the developer.

Various kinds of organic and inorganic chelating agents can be used in combination in the developer. Examples of the inorganic chelating agents include sodium tetrapolyphosphate and sodium hexametaphosphate.

Examples of the organic chelating agents include organic carboxylic acids, aminopolycarboxylic acids, organic phosphonic acids, aminophosphonic acids, and organic phosphonocarboxylic acids.

Examples of the organic carboxylic acids include acrylic acid, oxalic acid, malonic acid, succinic acid, glutaric acid, adipic acid, pimelic acid, acielaidic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminotetraacetic acid, and compounds disclosed in JP-A-52-25632, JP-A-55-67747, JP-A-57-102624 and JP-B-53-40900.

Examples of the organic phosphonic acids include hydroxyalkylidene-diphosphonic acid disclosed in U.S. Pat. Nos. 3,214,454, 3,794,591 and German Patent Publication No. 2,227,639, and compounds disclosed in *Research Disclosure*, Vol. 181, Item 18170 (May, 1979).

Examples of the aminophosphonic acids include aminotris(methylenephosphonic acid), ethylenediaminetetramethylenephosphonic acid, aminotrimethylenephosphonic acid, and compounds disclosed in *Research Disclosure*, No. 18170, JP-A-57-208554, JP-A-54-61125, JP-A-55-29883 and JP-A-56-97347.

Examples of the organic phosphonocarboxylic acids include compounds disclosed in JP-A-52-102726, JP-A-53-42730, JP-A-54-121127, JP-A-55-4024, JP-A-55-4025, JP-A-55-126241, JP-A-55-65955, and *Research Disclosure*, No. 18170.

These chelating agents may be used in the form of alkali metal salts or ammonium salts. They are preferably added in an amount of from $10\times^{-4}$ to $1\times10^{-1}$ mol, more preferably from $1\times10^{-3}$ to $1\times10^{-2}$ mol, per liter of the developer.

If needed, the developer may contain a color toning agent, a surfactant, an antifoaming agent, and a hardener.

The developer for use in the present invention may contain as a buffer carbonates, borates disclosed in JP-A-62-186259, saccharides (e.g., saccharose) disclosed in JP-60-93433, oximes (e.g., acetoxime), phenols (e.g., 5-sulfosalicylic acid), tertiary phosphates (e.g., sodium tertiary phosphate, potassium tertiary phosphate) or aluminum salts (e.g., sodium salt thereof). Among these, the carbonate and the borates are preferred. The developer preferably has a pH of from 9.0 to 11.5, more preferably from 9.5 to 11.0.

The development processing temperature and the development processing time are related reciprocally and determined in relationship with the total processing time, and generally, the processing temperature is from about 20° to 50° C., preferably from 25° to 45° C., and the processing time is from 5 seconds to 2 minutes, preferably from 7 seconds to one minute and 30 seconds.

If $m^2$ of a silver halide black-and-white photographic material is processed, the replenishment rate of the developer is 500 ml or less, preferably 400 ml or less.

Preferably, the processing solution is concentrated for preservation and is diluted when it is used in order to save the transportation cost, package material cost and spaces. The salt component contained in the developer is preferably a potassium salt to concentrate the developer.

The fixing solution for use in the fixing step in the present invention is an aqueous solution containing, for example, sodium thiosulfate or ammonium thiosulfate, and if needed, tartaric acid, citric acid, gluconic acid, boric acid, iminodiacetic acid, 5-sulfosalicylic acid, glucohepatnic acid, Tiron, ethylenediamine tertaacetic acid, diethylenetriamine pentaacetic acid, nitrilo triacetic acid, or salts thereof. However, the fixing solution preferably has no boric acid in view of the environmental preservation.

Examples of the fixing agent in the fixing solution for use in the present invention include sodium thiosulfate and ammonium thiosulfate. The sodium thiosulfate is preferred in view of the fixing velocity, however, the sodium thioammonium may be used in view of the environmental preservation. The amount added of the known fixing agent is not particularly limited, but is generally from about 0.1 to 2 mol/l, and particularly preferably from 0.2 to 1.5 mol/l.

The fixing solution can include, if needed, a hardening agent (e.g., water-soluble aluminum compound), a preservative agent (e.g., sulfite, bisulfite), a pH buffer (e.g., acetic acid), a pH adjustor (e.g., ammonia, sulfuric acid), a chelating agent, a surfactant, a wetting agent, and a fixing accelerator.

Examples of the surfactant include an anionic surfactant (e.g., sulfated product, sulfonated product), a polyethylene surfactant, and amphoteric surfactants disclosed in JP-A-57-6840, and known defoaming agents can also be used. Examples of the wetting agent include alkanolamine and alkylene glycol. Examples of the fixing accelerator include thiourea derivatives disclosed in JP-B-45-35754, JP-B-58-122535 and JP-B-58-122536, alcohols having a triple bond in the molecule, thioether compounds disclosed in U.S. Pat. No. 4,126,459, mesoionic compounds disclosed in JP-A-4-229860, and compounds disclosed in JP-A-2-44355.

Examples of the pH buffer include an organic acid such as acetic acid, malic acid, succinic acid, tartaric acid, citric acid, maleic acid, glycol acid and adipic acid, an inorganic buffer such as boric acid, phosphate and sulfite. Among these, preferred are acetic acid, tartaric acid and sulfite.

The pH buffer is used for inhibiting the pH increase of the fixing solution by incorporation of the developer. The pH buffer is used in an amount of from 0.01 to 1.0 mol/l, preferably from 0.02 to 0.6 mol/l.

The pH of the fixing solution is preferably from 4.0 to 6.5, more preferably from 4.5 to 6.0.

Compounds disclosed in JP-A-64-4739 can be used as a dye dissolution accelerator.

Examples of the hardener in the fixing solution include water-soluble aluminum salts and chromium salts. The water-soluble ammonium salt is preferred and examples thereof include aluminum chloride, aluminum sulfate and potassium alum. The amount added thereof is preferably from 0.01 to 0.2 mol/l, more preferably from 0.03 to 0.08 mol/l.

The fixing temperature is from about 20° to 50° C., preferably from 25° to 45° C.; and the fixing time is from 5 seconds to one minute, preferably from 7 to 50 seconds.

The replenishing amount of the fixing solution is preferably 600 ml or less, more preferably 500 ml or less, per $m^2$ of the processed light-sensitive material.

The photographic material is processed with washing water or a stabilizing solution after the development and fixation steps. The washing or stabilizing steps are generally carried out by using washing water or a stabilizing solution at a replenishment rate of 20 l or less per $m^2$ of silver halide photographic material. However, the replenishment rate may be 3 l or less (including the replenishment rate of zero, namely the washing with stored water) per $m^2$ of silver halide photographic material. That is, not only economizing water in the washing step but also making a piping work unnecessary in setting up an automatic developing machine becomes possible.

The multistage (e.g., two-stage or three-stage) counter current process has been known for a long time as a method for reduction in replenishment of washing water. If this process is applied to the present invention, the fixation-processed photographic material is processed as it is brought into contact with successive, more and more cleaned processing solutions, that is, processing solutions less and less contaminated with the fixer. Accordingly, more efficient washing can be carried out.

When the washing step is performed with a small amount of water, it is preferred to use a washing tank equipped with squeeze rollers or crossover rollers, as disclosed in JP-A-63-18350 and JP-A-62-287252. Further, the addition of various kinds of oxidizing agents and the filtration may be supplemented for the purpose of reduction in pollution load. An increase in pollution load is a big problem that the washing with little water faces.

Part or all of the overflow generated from the washing or stabilizing bath by replenishing the bath with the water, which is rendered moldproof by the above-cited means, in proportion as the processing proceeds according to the present invention can be used in the prior step wherein the processing solution having a fixability is used, as described in JP-A-60-235133.

Moreover, a water-soluble surfactant or a defoaming agent may be included in washing water to prevent generation of irregular foaming which is liable to generate when washing is conducted with a small amount of water and/or to prevent components of the processing agents adhered to a squeegee roller from transferring to the processed film.

In addition, dye adsorbents disclosed in JP-A-63-163456 may be included in a washing tank to inhibit contamination by dyes dissolved from photographic materials.

When a photographic material is subjected to stabilizing processing after the washing processing, bath containing compounds disclosed in JP-A-2-201357, JP-A-2-132435, JP-A-1-102553 and JP-A-46-44446 may be used as a final bath.

This stabilizing bath may contain, if needed, ammonium compounds, metal compounds such as Bi and Al, brightening agents, various kinds of chelating agents, film pH adjustors, hardening agents, sterilizers, antimold agents, alkanolamines, and surfactants. Tap water, deionized water, and water sterilized by a halogen, ultraviolet sterilizing lamp or various oxidizing agents (e.g., ozone, hydrogen peroxide, chlorate) or tap water containing compounds disclosed in JP-A-4-39652 and JP-A-5-241309 are preferably used as washing water in a washing step or a stabilizing step.

The temperature and time of the washing and stabilizing bath processing are preferably from 0° to 50° C. and from 5 seconds to 2 minutes.

The processing solution for use in the present invention is preferably stored in a package material slightly pervious to oxygen as disclosed in JP-A-61-73147.

The processing solution for use in the present invention may form a powder agent or a solid material. The formation may be carried out by known methods, and methods disclosed in JP-A-61-259921, JP-A-4-85533 and JP-A-16841 are preferred, and the method disclosed in JP-A-61-259921 is particularly preferred.

When the replenishing amount is lowered, the evaporation and air oxidation of the solution are inhibited by reducing the contact area of the solution and the air of the solution tank. Automatic developing machines of roller conveyance type are described in, e.g., U.S. Pat. Nos. 3,025,779 and 3,545,971, and the present invention refers them to simply as processors of roller conveyance type. A processor of roller conveyance type involves four processes, namely development, fixation, washing and drying processes. Also, it is most advantageous for the present method to follow those four processes, although the present method does not exclude other processes (e.g., stop process). The four processes may contain a stabilizing step in place of the washing step.

The silver halide photographic material of the present invention may contain a hydrazine derivative as a nucleating agent. The hydrazine derivative is preferably added to the same layer to which the compound represented by formula (I) or (II) is added. However, as long as the layer to which the hydrazine derivative and the layer to which the compound represented by formula (I) or (II) is added are within the same plane, these layers may be different.

The hydrazine derivative for use in the present invention is preferably a compound represented by the following formula (IV):

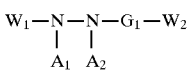

$$W_1-\underset{\underset{A_1}{|}}{N}-\underset{\underset{A_2}{|}}{N}-G_1-W_2 \qquad \text{(IV)}$$

wherein $W_1$ represents an aliphatic group or an aromatic group; $W_2$ represents a hydrogen atom, an alkyl group, an aryl group, an aralkyl group, an unsaturated heterocyclic group, an alkoxy group, an aryloxy group, an amino group or a hydrazino group, which each may be substituted; $G_1$ represents —CO—, —$SO_2$—, —SO—, —PO($W_3$)—, —CO—CO—, a thiocarbonyl group or an iminomethylene group; $A_1$ and $A_2$ are both a hydrogen atom, or one of them is a hydrogen atom and the other is a substituted or unsubstituted alkylsulfonyl group, a substituted or unsubstituted arylsulfonyl group or a substituted or unsubstituted acyl group; $W_3$ has the same meaning as $W_2$, but it may be different from $W_2$.

The compound represented by formula (IV) will now be described in detail.

In formula (IV), the aliphatic group represented by $W_1$ is preferably an aliphatic group having from 1 to 30 carbon atoms, more preferably a straight-chain, branched or cyclic alkyl group having from 1 to 20 carbon atoms. The branched alkyl group may be cyclized to form a saturated heterocyclic ring containing one or more hetero atoms in the alkyl group. The alkyl group may be substituted with one or more substituent.

The aromatic group represented by $W_1$ in formula (IV) includes a monocyclic or dicyclic aryl or unsaturated heterocyclic group. The unsaturated heterocyclic group represented by $W_1$ may form a heteroaryl group by fusing a monocyclic or dicyclic aryl group. Examples of the ring formed by $W_1$ include a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring. Among these, preferred is a benzene ring.

$W_1$ is more preferably an aryl group.

The aliphatic or aromatic group represented by $W_1$ may be substituted with one or more substituents. Examples of the substituents include an alkyl group, an alkenyl group, an alkynyl group, an aryl group, a heterocyclic group, a pyridinium group, a hydroxyl group, an alkoxy group, an aryloxy group, an acyloxy group, an alkylsulfonyloxy group, an arylsulfonyloxy group, an amino group, a carbonamido group, a sulfonamido group, a ureido group, a thioureido group, a semicarbazido group, a thiosemicarbazido group, a urethane group, a group having a hydrazide structure, a group having a quaternary ammonium structure, an alkylthio group, an arylthio group, an alkylsulfonyl group, an arylsulfonyl group, an alkylsulfinyl group, an arylsulfinyl group, a carboxyl group, a sulfo group, an acyl group, an alkoxycarbonyl group, an aryloxycarbonyl group, a carbamoyl group, a sulfamoyl group, a halogen atom, a cyano group, a phosphonamido group, a diacylamino group, an imido group, a group having an acylurea structure, a group containing a selenium atom or a tellurium atom, and a group having a tertiary sulfonium structure or a quaternary sulfonium structure. Of these, preferred are a strain-chain, branched or cyclic alkyl group (preferably alkyl group having from 1 to 20 carbon atoms), an aralkyl group (preferably monocyclic or dicyclic aralkyl group containing an alkyl moiety having from 1 to 3 carbon atoms), an alkoxy group (preferably alkoxy group having from 1 to 20 carbon atoms), a substituted amino group (preferably amino group substituted with at least one alkyl group having from 1 to 20 carbon atoms), an acylamino group (preferably acylamino group having from 2 to 30 carbon atoms), a sulfonamido group (preferably sulfonamido group having from 1 to 30 carbon atoms), a ureido group (preferably ureido group having from 1 to 30 carbon atoms) and a phosphonamido group (preferably phosphonamido group having from 1 to 30 carbon atoms).

In formula (Iv), the alkyl group represented by $W_2$ is preferably an alkyl group having from 1 to 4 carbon atoms, and the aryl group represented by $W_2$ is preferably a monocyclic or dicyclic aryl group such as an aryl group containing a benzene ring.

The unsaturated heterocyclic group represented by $W_2$ is preferably a 5- or 6-membered ring containing at least one nitrogen, oxygen or sulfur atom. Examples thereof include an imidazolyl group, a pyrazolyl group, a triazolyl group, a tetrazolyl group, a pyridyl group, a pyridinium group, a quinolinium group and a quinolinyl group. Among these, more preferred are a pyridyl group and a pyridinium group.

The alkoxy group represented by $W_2$ is preferably an alkoxy group having from 1 to 8 carbon atoms. The aryloxy group represented by $W_2$ is preferably a monocyclic aryloxy group. The amino group represented by $W_2$ is preferably an unsubstituted amino group or an alkylamino or arylamino group having from 1 to 10 carbon atoms.

$W_2$ may be substituted with one or more substituents, and examples of the substituents include those recited above with respect to $W_1$.

When $G_1$ represents —CO—, $W_2$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl) or an aryl group (e.g., phenyl, 3,5-dichlorophenyl, o-methanesulfonamidophenyl, 4-methanesulfonylphenyl, 2-hydroxymethylphenyl), and more preferably a hydrogen atom or a trifluoromethyl group.

When $G_1$ represents —$SO_2$—, $W_2$ is preferably an alkyl group (e.g., methyl), an aralkyl group (e.g., o-hydroxybenzyl), an aryl group (e.g., phenyl) or a substituted amino group (e.g., dimethylamino).

When $G_1$ represents —CO—CO—, $W_2$ is preferably an alkoxy group, an aryloxy group or an amino group.

In formula (IV), $G_1$ is preferably —CO— or —CO—CO—, and more preferably —CO—.

Further, $W_2$ may be a group such that it can split the $G_1$–$W_2$ moiety off the residual molecule and thereby cause the cyclization reaction to form a cyclic structure containing the atoms of the $G_1$–$W_2$ moiety. Specific examples of such a group include those disclosed in JP-A-63-29751.

$A_1$ and $A_2$ are each preferably a hydrogen atom, an alkylsulfonyl or arylsulfonyl group having from 1 to 20 carbon atoms (more preferably, a phenylsulfonyl group or a phenylsulfonyl group substituted with substituent(s) having Hammett's reaction constant of −0.5 or more, such as a p-methylphenylsulfonyl group, a pentafluorophenylsulfonyl group, a p-ethoxycarbonylphenylsulfonyl group, a m-methoxyphenylsulfonyl group and a p-cyanophenylsulfonyl group) or an acyl group having from 1 to 20 carbon atoms (more preferably, a benzoyl group, a benzoyl group substituted with substituent(s) having Hammett's reaction constant of −0.5 or more, such as a p-methylbenzoyl group, a pentafluorobenzoyl group, a p-ethoxycarbonylbenzoyl group, a m-methoxybenzoyl group and a p-cyanobenzoyl group, or a straight-chain, branched or cyclic acyl group, which may be substituted with substituent(s) such as a halogen atom, an ether group, a sulfonamido group, a carbonamido group, a hydroxyl group, a carboxyl group or a sulfonic acid group).

$A_1$ and $A_2$ are each more preferably a hydrogen atom.

The substituents of $W_1$ and $W_2$ may be further substituted with one or more substituents, and examples of the substituents include those recited above with respect to $W_1$. The substituted substituents may be further substituted with a substituent, a substituted substituent, a ((substituted substituent)-substituted substituent, and so on, and the examples of the substituents also include those recited above with respect to $W_1$.

Moreover, $W_1$ or $W_2$ in formula (IV) may be a group into which a ballast group used commonly in immobile photographic additives, such as couplers, or a polymer is introduced. The ballast group is a group containing 8 or more carbon atoms and having a relatively slight influence upon photographic properties, and examples thereof include an alkyl group, an aralkyl group, an alkoxy group, a phenyl group, an alkylphenyl group, a phenoxy group, and an alkylphenoxy group. Examples of the polymer include those described in JP-A-1-100530.

Furthermore, $W_1$ or $W_2$ in formula (IV) may be a group into which a group capable of intensifying the adsorption onto the grain surface of silver halide is introduced. Examples of the adsorption-intensifying group include an alkylthio group, an arylthio group, a thiourea group, a heterocyclic thioamido group, a mercapto heterocyclic group and a triazole group, such as described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

The particularly preferred hydrazine derivative in the present invention is a hydrazine derivative represented by formula (IV), wherein $W_1$ is a group capable of accelerating the adsorption onto a ballast group or a surface of silver halide grains or a phenyl group, a group having a quaternary ammonium structure or an alkylthio group; $G_1$ is —CO—; $W_2$ is a hydrogen atom or a substituted alkyl or substituted aryl group (the substituent thereof is preferably an electron attracting group or a hydroxymethyl group to the 2-position thereof). All the combinations of the above-described $W_1$ and $W_2$ can be selected and are preferred.

Specific examples of the compound represented by formula (IV) are illustrated below. However, the invention should not be construed as being limited to these examples.

IV-1

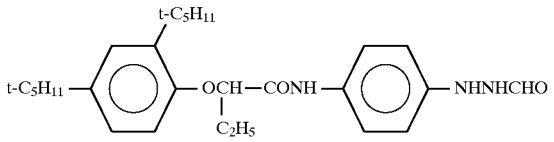

IV-2

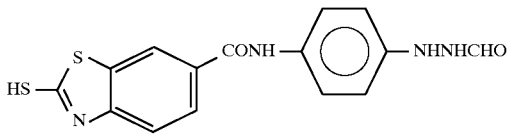

IV-3

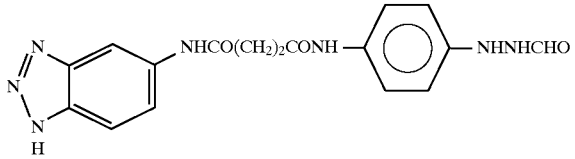

-continued
IV-4
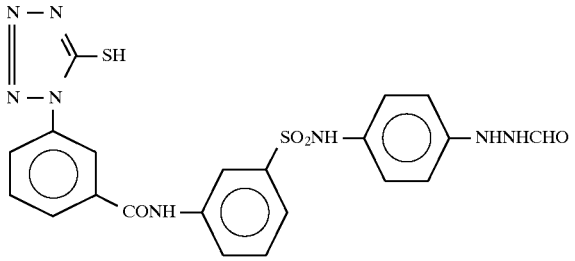
IV-5
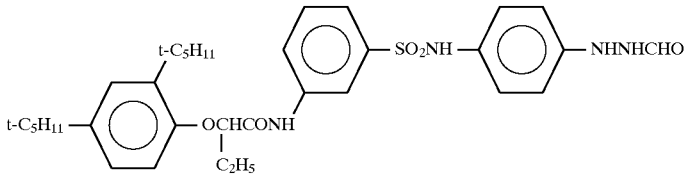
IV-6
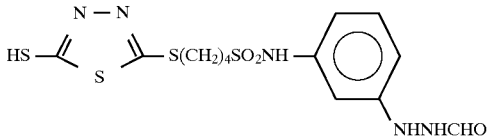
IV-7
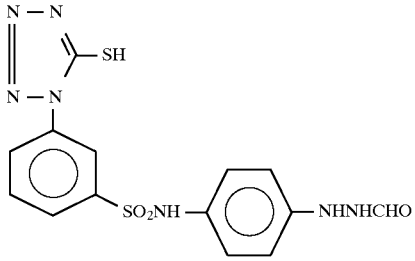
IV-8
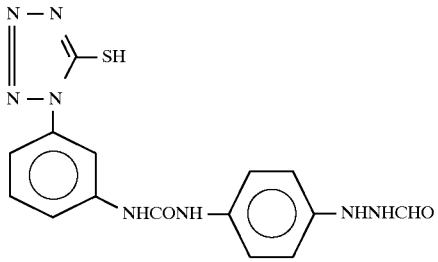
IV-9
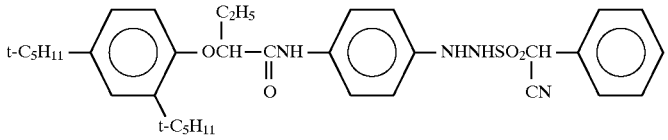
IV-10
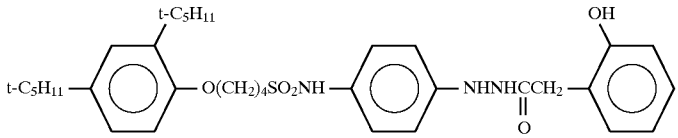
IV-11
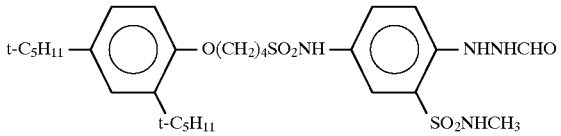

-continued
IV-12
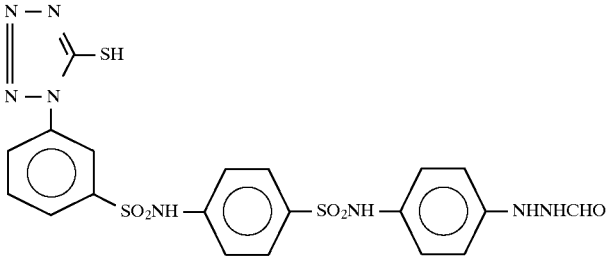
IV-13
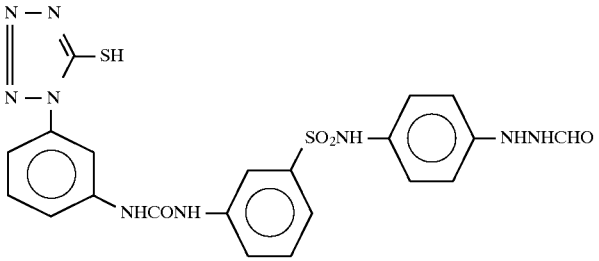
IV-14
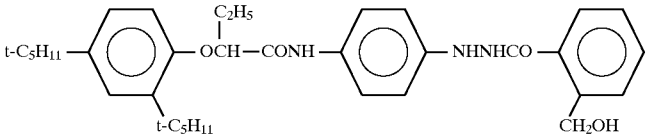
IV-15
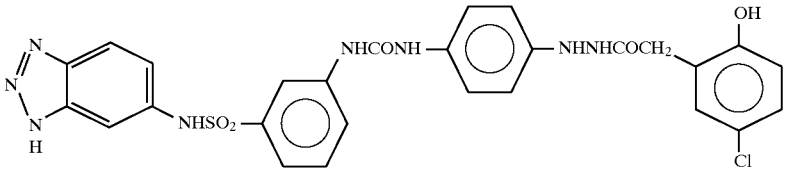
IV-16
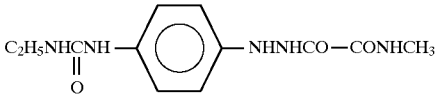
IV-17
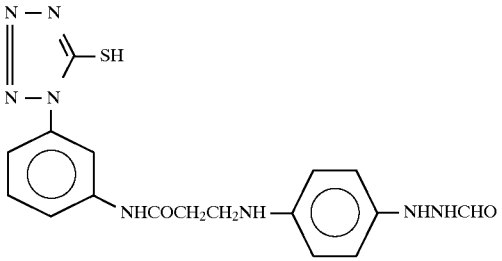
IV-18
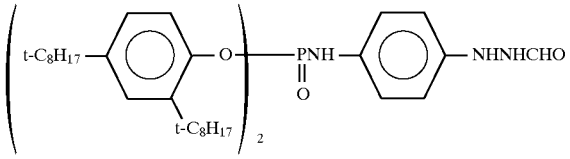
IV-19
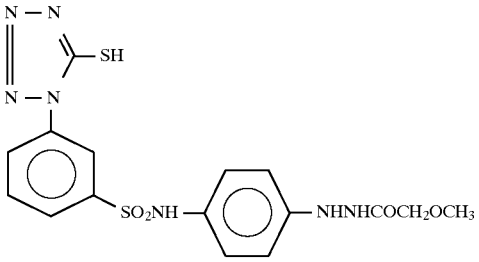

-continued
IV-20
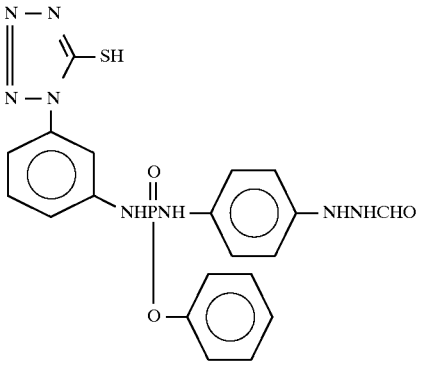
IV-21
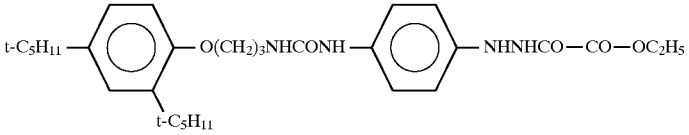
IV-22
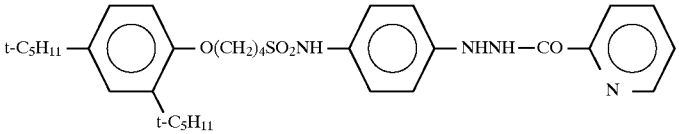
IV-23
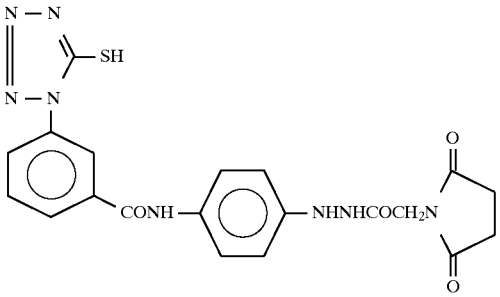
IV-24
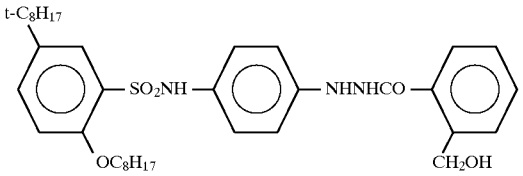
IV-25
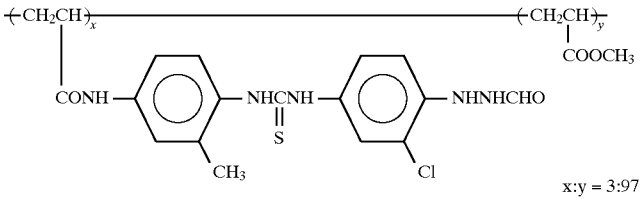
x:y = 3:97
Average molecular weight = about 100,000
IV-26
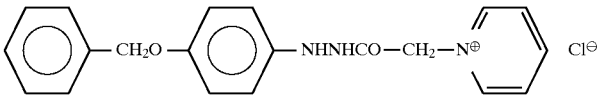
IV-27
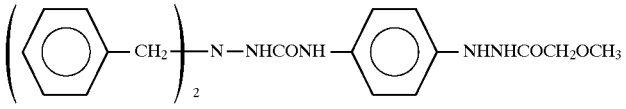

-continued
IV-28
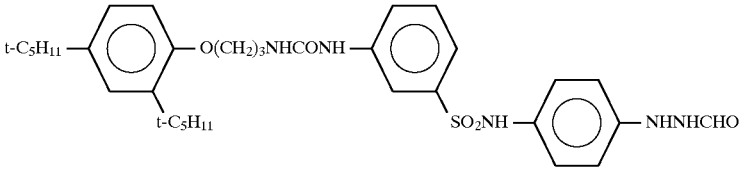
IV-29
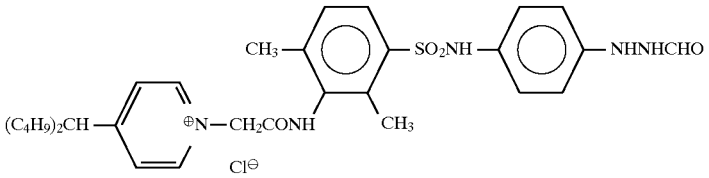
IV-30
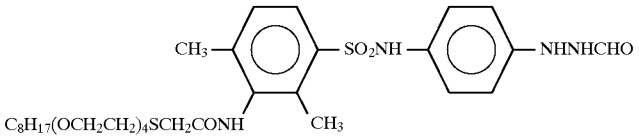
IV-31
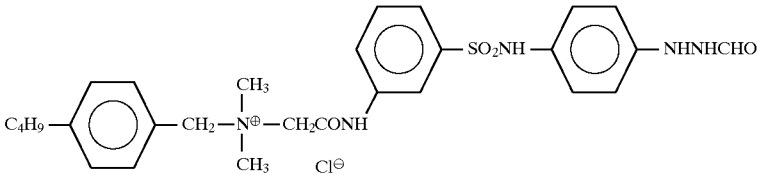
IV-32
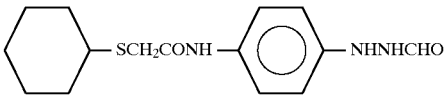
IV-33
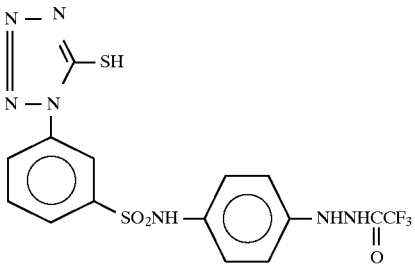
IV-34
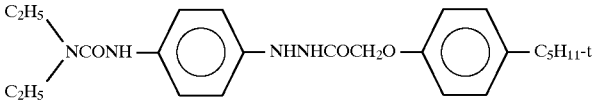
IV-35
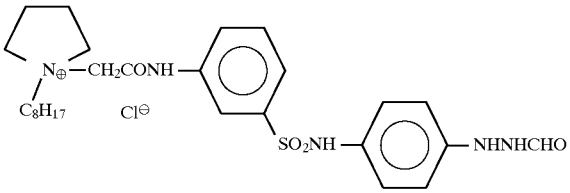
IV-36
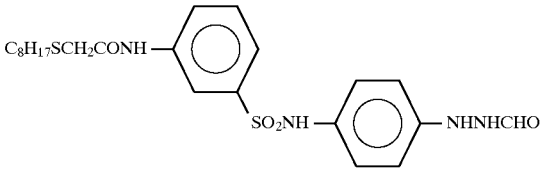

-continued
IV-37
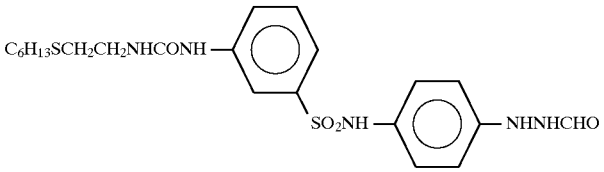
IV-38
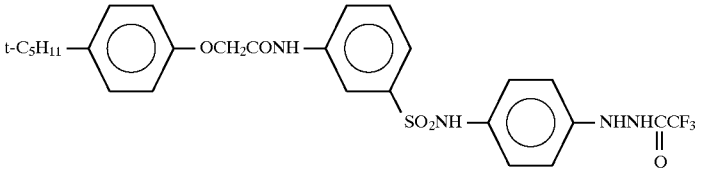
IV-39
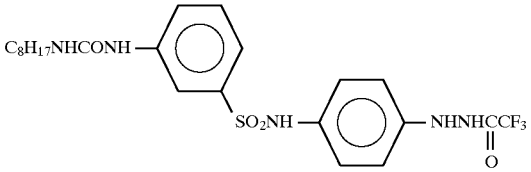
IV-40
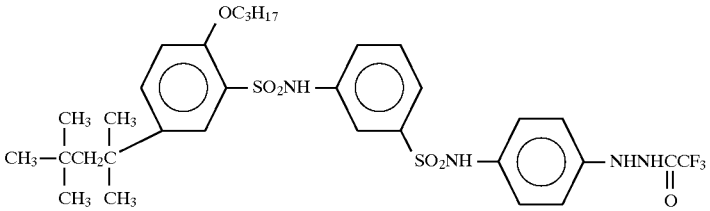
IV-41
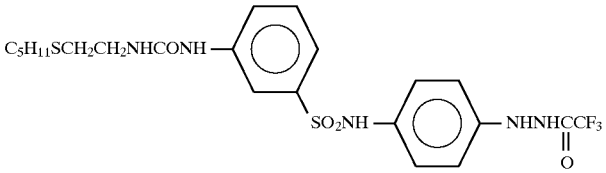
IV-42
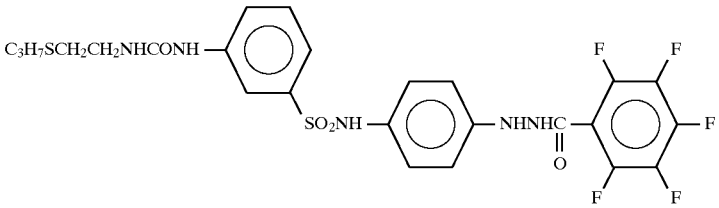
IV-43
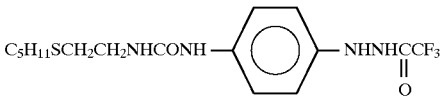
IV-44
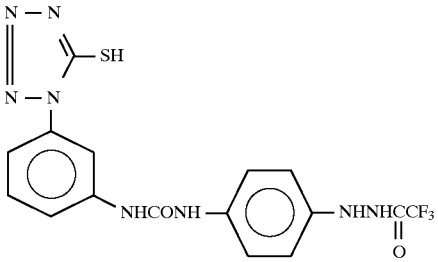

-continued
IV-45
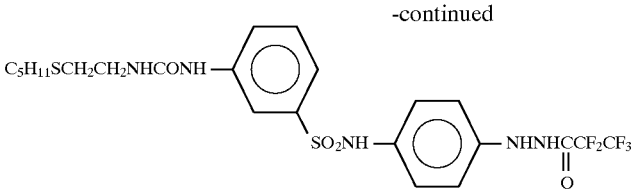
IV-46
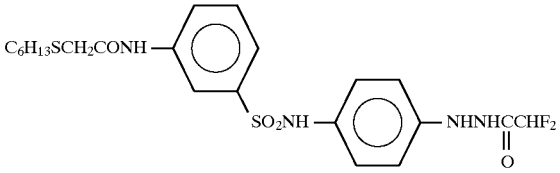
IV-47
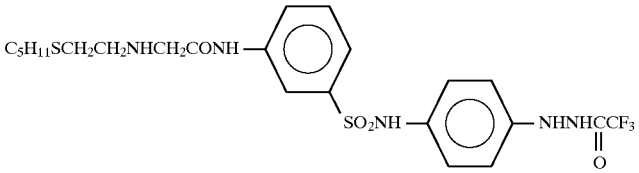
IV-48
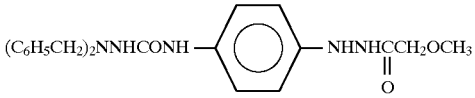
IV-49
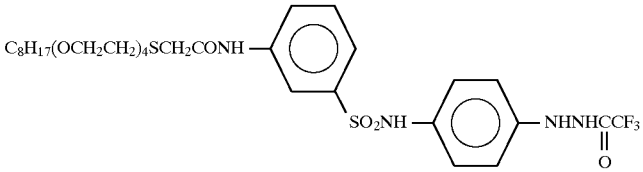
IV-50
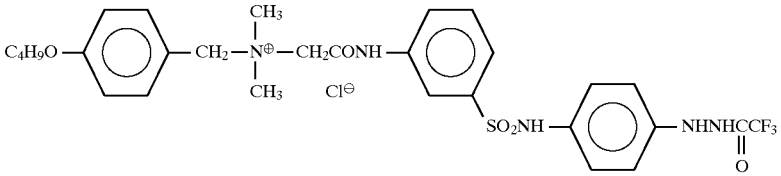
IV-51
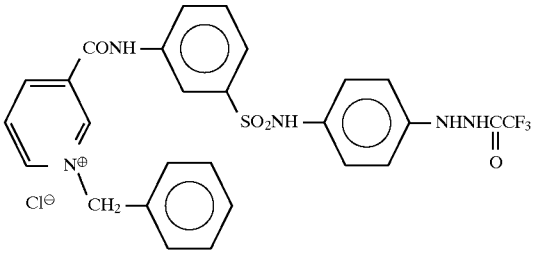
IV-52
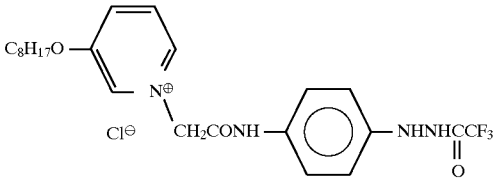
IV-53
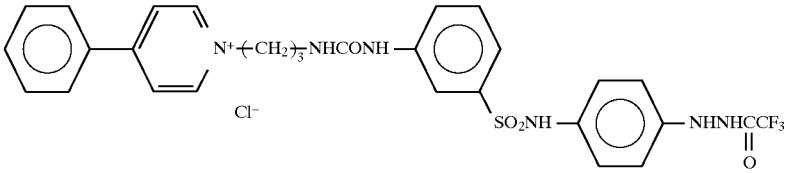

In addition to the above-illustrated examples, examples of the hydrazine derivative for use in the present invention include those disclosed in Research Disclosure, Item 23516, p.346 (November, 1983), the references cited in ibid., U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355 and 5,104,769, British Patent No. 2,011,391B, European Patent Nos. 217, 310, 301,799 and 356,898, JP-A-60-179734, JP-A-61-170733, JP-A-61-270744, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764 and JP-A-5-45765, and JP-A-6-289542.

The hydrazine derivative for use in the present invention is preferably added in an amount of from $1\times10^{-6}$ to $5\times10^{-2}$ mol, more preferably from $1\times10^{-5}$ to $2\times10^{-2}$ mol, per mol of silver halide.

In using the hydrazine derivative in the present invention, it may be dissolved in a proper water-miscible organic solvent, such as alcohol (e.g., methanol, ethanol, propanol, fluorinated alcohol), ketone (e.g., acetone, methyl ethyl ketone), dimethylformamide, dimethylsulfoxide and methyl cellosolve.

Furthermore, the hydrazine derivative can be used in the form of emulsified dispersion, which is prepared using the well-known emulsion dispersion method in which the hydrazine derivative is dissolved using an oil such as dibutyl phthalate, tricresyl phosphate, glyceryl triacetate and diethyl phthalate, together with an auxiliary solvent, such as ethyl acetate and cyclohexanone, and then dispersed mechanically in an emulsified condition. On the other hand, the so-called solid dispersion method can be adopted in using the hydrazine derivative, wherein the powdered hydrazine derivative is dispersed into water with a ball mill, a colloid mill or ultrasonic waves.

The silver halide emulsion for use in the present invention may be silver chloride, silver bromide, silver chlorobromide, silver iodobromide or silver iodochlorobromide.

Photographic emulsions for use in the present invention can be prepared using methods described in, e.g., P. Glafkides, *Chemie et Physique Photographique*, Paul Mantel, (1967), G. F. Duffinu, *Photographic Emulsion Chemistry*, The Focal Press, (1966), V. L. Zelikman et al., *Making and Coating Photographic Emulsion*, The Focal Press, (1964).

In the silver halide emulsion according to the present invention, the monodispersion emulsion preferably has a variation coefficient of 20% or less, preferably 15% or less. The term "variation coefficient (%)" used herein means a value obtained by dividing the standard deviation of the particle size by the average value of the particle size and multiplying it by 100.

The grains in the monodispersion silver halide emulsion has an average particle size of 0.5 $\mu$m or less, more preferably from 0.1 to 0.4 $\mu$m.

Examples of methods for reacting a water-soluble silver salt (silver nitrate solution) with a water-soluble halogen salt include a single jet method, a double jet method, and a combination thereof. As one form of the double jet method, the method in which the pAg of the liquid phase wherein silver halide grains are to be precipitated is maintained constant, that is, a controlled double jet method, may be used. Further, it is preferred that grains are formed by using the so-called silver halide solvent, such as ammonia, thioethers and tetrasubstituted thioureas.

More preferably, substituted thiourea compounds as disclosed in JP-A-53-82408 and JP-A-55-77737 are used. Preferable thiourea compounds include tetramethylthiourea and 1,3-dimethyl-2-imidazolidinethione.

According to the controlled double jet method and the grain formation method using a silver halide solvent, a silver halide emulsion having a regular crystal shape and a narrow distribution of grain sizes can be obtained with ease, and so these methods are useful for making the silver halide emulsions used in the present invention.

The monodispersion emulsion preferably has a regular crystal form, such as a cubic form, an octahedral form or a tetradecahedral form, more preferably a cubic form.

The silver halide grains may have uniform phases between the inside and the outer layer, or may have different phases therebetween.

In the present invention, the silver halide emulsion particularly suitable for line work photographing or for halftone dot preparation is preferably prepared in the prepense of iridium salts or complexes thereof in an amount of from $10^{-8}$ to $10^{-5}$ mol per mol of silver.

In the present invention, the photographic material particularly suitable for dot-to-dot working (contact working), the silver halide emulsion comprises preferably silver halide having a sliver chloride content of 90 mol % or more, more preferably 95 mol % or more, or silver chlorobromide or silver chloroiodobromide having a silver bromide content of from 0 to 10 mol %. If the ratio of the silver bromide or silver iodide is increased, it is not preferred because the safe light safety in daylight is deteriorated and $\gamma$ is lowered.

The silver halide emulsion for use in the present invention may be chemically sensitized. Examples of the chemical sensitization include known methods, such as a sulfur sensitization method, a selenium sensitization method, a tellurium sensitization method, a noble metal sensitization method, and a reduction sensitization method. These methods can be used alone or in combination. In the combined use, a sulfur sensitization method and a gold sensitization method; a sulfur sensitization method, a selenium sensitization and a gold sensitization method; or a sulfur sensitization method, a tellurium sensitization method and a gold sensitization method are preferably used.

The sulfur sensitization for use in the present invention can be generally effected by adding a sulfur sensitizer to an emulsion and stirring the emulsion for a prescribed time under a temperature of 40° C. or more. As for the sulfur sensitizer, known compounds including not only sulfur compounds contained in gelatin but also thiosulfates, thioureas, thiazoles, and rhodanines can be used. Of these sulfur sensitizers, thiosulfates and thiourea compounds are preferred. The amount of the sulfur sensitizer added, though it is changed depending on various conditions, such as the pH and the temperature at the time of chemical sensitization and the size of silver halide grains, is from $10^{-7}$ to $10^{-2}$ mol, preferably from $10^{-5}$ to $10^{-3}$ mol, per mol of silver halide.

Selenium sensitizers for use in the present invention include known selenium compounds. In general, selenium sensitization can be effected by adding an unstable selenium compound and/or a nonunstable selenium compound to the silver halide emulsion and agitating the resulting emulsion at a high temperature, preferably 40° C. or more, for a definite time. Suitable examples of the unstable selenium compounds include those disclosed in JP-B-44-15748, JP-B-43-13489, JP-A-4-25832, JP-A-4-109240 and JP-A-4-324855. The compounds represented by formula (VIII) or (IX) described in JP-A-4-324855 are preferably used.

Tellurium sensitizers for use in the present invention are compounds capable of producing silver telluride, which is presumed to act as a sensitization nucleus, at the surface or the inside of silver halide grains. The production rate of silver telluride in a silver halide emulsion can be examined by the method disclosed in JP-A-5-313284.

Specific examples of the tellurium sensitizers include the compounds disclosed in U.S. Pat. Nos. 1,623,499, 3,320,069 and 3,772,031; British Patent Nos. 235,211, 1,121,496, 1,295,462 and 1,396,696; Canadian Patent No. 800,958, JP-A-4-204640, JP-A-4-271341, JP-A-4-333043 and JP-A-4-129787; *J. Chem. Soc. Commun.,* 635 (1980); ibid. 1102 (1979); ibid. 645 (1979); *J. Chem. Soc. Perkin. Trans.,* 1, 2191 (1980); S. Patai (compiler), *The Chemistry of Organic Selenium and Tellurium Compounds*, Vol. 1 (1986); and ibid. Vol. 2 (1987). In particular, the compounds represented by formulae (II), (III) and (IV) in JP-A-5-313284 are preferred.

The amounts of selenium and tellurium sensitizers for use in the present invention, though they depend on the conditions under which the silver halide grains are ripened chemically, are generally from $10^{-8}$ to $10^{-2}$ mol, preferably from $10^{-7}$ to $10^{-3}$ mol, per mol of silver halide. The chemical sensitization, although the present invention does not impose any particular restriction thereon, is generally carried out at a pH of from 5 to 8, at a pAg of from 6 to 11, preferably from 7 to 10, and at a temperature of from 40° to 95° C., preferably from 45° to 85° C.

Examples of the noble metal sensitizers for use in the present invention include gold, platinum and palladium. In particular, gold sensitizers are preferred. Suitable examples of such gold sensitizers include chloroauric acid, potassium chloroaurate, potassium aurithiocyanate and auric sulfide. These sensitizers can be used in an amount of from $10^{-7}$ to $10^{-2}$ mol per mol of silver halide.

In a process of producing silver halide emulsion grains for use in the present invention or allowing the produced grains to ripen physically, a cadmium salt, sulfide, a lead salt, and a thallium salt may be present.

Further, reduction sensitization can be adopted in the present invention. Examples of the reduction sensitizer include stannous salts, amines, formamidinesulfinic acid and silane compounds.

To the silver halide emulsions for use in the present invention, thiosulfonic acid compounds may be added according to the method described in European Patent (EP) No. 293,917.

The photographic material for use in the present invention may contain only one kind of silver halide emulsion or not less than two kinds of silver halide emulsions (differing in average grain size, halide composition, crystal habit or chemical sensitization condition).

The photographic material for use in the present invention may contain a rhodium compound to obtain a high contrast or a low fog.

Water-soluble rhodium compounds are used as the rhodium compound for use in the present invention. Suitable examples thereof include a rhodium(III) halide compound and a rhodium complex salt containing as a ligand halogen, amine, oxalate, such as a hexachlororhodium(III) complex salt, a hexabromorhodium(III) complex salt, a hexaamminerhodium(III) complex salt and a trioxalatorhodium(III) complex salt. In using these rhodium compounds, they are dissolved in water or an appropriate solvent. In order to stabilize the solution of a rhodium compound, a conventional method, that is, a method of adding an aqueous solution of halogenated acid (e.g., hydrochloric acid, hydrobromic acid, hydrofluoric acid) or an alkali halide (e.g., KCl, NaCl, KBr, NaBr), can be adopted. Instead of using a water-soluble rhodium compound, it is possible to incorporate rhodium into emulsion grains by adding rhodium-doped silver halide grains to the silver halide preparation system and dissolving the grains therein.

The amount added of the rhodium compounds is from $1\times10^{-8}$ to $5\times10^{-6}$ mol, preferably from $5\times10^{-8}$ to $1\times^{-6}$, per mol of silver halide finally formed. These compounds can be properly added during silver halide emulsion grains are formed, or at any stage prior to the emulsion coating. In particular, they are preferably added during sliver halide emulsion grains are formed to be incorporated into silver halide grains.

In the present invention, the silver halide photographic material may contain an iridium compound to obtain a high contrast or a low fog.

Examples of the iridium compound for use in the present invention include various iridium compounds, e.g., hexachloroiridium, hexaammineiridium, trioxalatoiridium, hexacyanoiridium. In using these iridium compounds, they are dissolved in water or an appropriate solvent. In order to stabilize the solution of an iridium compound, a conventional method, that is, a method of adding an aqueous solution of halogenated acid (e.g., hydrochloric acid, hydrobromic acid, hydrofluoric acid) or alkali halide (e.g., KCl, NaCl, KBr, NaBr), can be adopted. Instead of using a water-soluble iridium compound, it is possible to incorporate iridium into emulsion grains by adding iridium-doped silver halide grains to the silver halide preparation system and dissolving the grains therein.

The total amount added of the iridium compound is from $1\times10^{8}$ to $5\times10^{-5}$ mol, preferably from $1\times10^{-8}$ to $1\times10^{-6}$ mol, per mol of silver halide which is finally formed.

These compounds can be properly added during silver halide emulsion grains are formed, or at any stage prior to the emulsion coating. In particular, they are preferably added during sliver halide emulsion grains are formed to be incorporated into silver halide grains.

Further, the silver halide grains for use in the present invention may contain metal atoms, such as iron, cobalt, nickel, ruthenium, palladium, platinum, gold, thallium, copper, lead and osmium. These metals are preferably used in an amount of from $1\times10^{-9}$ to $1\times10^{-4}$ mol per mol of silver halide. The metals can be added to the grains in the form of metal salt, such as single, double and complex salts, during the grain formation.

The silver halide emulsion for use in the silver halide photographic material of the present invention may contain at least one metal selected from rhenium, ruthenium and osmium. They are preferably added in an amount of from $1\times10^{-9}$ to $1\times10^{-5}$ mol, more preferably from $1\times10^{-8}$ to $1\times10^{-6}$ mol, per mol of silver. These metals may be used alone or as a mixture of two or more thereof. The metals can be distributed evenly throughout the grains, or can be distributed in a specified pattern as described in JP-A-63-29603, JP-A-2-306236, JP-A-3-167545, JP-A-4-76534, JP-A-5-273746 and JP-A-6-110146.

The rhenium, ruthenium and osmium is added in the form of water-soluble complex salt disclosed in, for example, JP-A-63-2042, JP-A-1-285941, JP-A-2-20852, JP-A-2-20855. Particularly, the following six-coordination complexes are preferred:

$$[ML_6]^{-n}$$

wherein M represents Ru, Re or Os; L represents a ligand; and n represents 0, 1, 2, 3 or 4. In this case, a counter ion is of no importance, so that an ammonium ion or an alkali metal ion is used as the counter ion.

Preferable examples of the ligand include a halide ligand, a cyanide ligand, a cyan oxide ligand, a nitrosyl ligand or a thionitrosyl ligand. Specific examples of the metal complexes for use in the present invention are given below. However, the invention should not construed as being limited to these examples.

| | | |
|---|---|---|
| $[ReCl_6]^{-3}$ | $[ReBr_6]^{-3}$ | $[ReCl_5(NO)]^{-2}$ |
| $[Re(NS)Br_5]^{-2}$ | $[Re(NO)(CN)_5]^{-2}$ | $[Re(O)_2(NO)_4]^{-3}$ |
| $[RuCl_6]^{-3}$ | $[RuCl_4(H_2O)_2]^{-2}$ | $[RuCl_5(NO)]^{-2}$ |
| $[RuBr_5(NS)]^{-2}$ | $[Ru(CN)_6]^{-4}$ | $[Ru(CO)_3Cl_3]^{-2}$ |
| $[Ru(CO)Cl_5]^{-2}$ | $[Ru(CO)Br_5]^{-2}$ | |
| $[OSCl_5]^{-3}$ | $[OsCl_5(NO)]^{-2}$ | $[Os(NO)(CN)_5]^{-2}$ |
| $[Os(NS)Br_5]^{-2}$ | $[Os(CN)_6]^{-4}$ | $[Os(O)_2(CN)_4]^{-4}$ |

These metal complexes may be properly added at the time silver halide emulsion grains are formed, or at any stage prior to the emulsion coating. In particular, they are preferably added at the time the emulsion is formed to be incorporated into silver halide grains.

In order to incorporate such a metal complex as cited above into silver halide grains by adding it during the grain formation, the following methods can be adopted, that is, the method of adding in advance a solution prepared by dissolving in water the metal complex powder or its mixture with NaCl or KCl to either a water-soluble salt solution or a water-soluble halide solution for the grain formation; the method of forming silver halide grains by simultaneously admixing three solutions, namely a silver salt solution, a halide solution and the foregoing metal complex powder-containing solution as the third solution; or the method of pouring a water solution of the metal complex in a desired amount into the reaction vessel under grain formation. In particular, preferred is the method of adding to an aqueous halide solution a solution prepared by dissolving in water the metal complex powder together with NaCl or KCl.

In order to make such a metal complex adsorb to the grain surface, an aqueous solution thereof may be poured into the reaction vessel in a required amount just after the grain formation, during or at the conclusion of physical ripening, or at the time of chemical ripening.

Silver halide grains for use in the present invention may be doped by other heavy metal salts. In particular, the doping of an Fe complex salt, such as $K_4[Fe(CN)_6]$, is preferred.

Furthermore, in the present invention, other metals contained in Group VIII, such as cobalt, nickel, iridium, palladium, and platinum, may be used in combination. Particularly, iridium salts such as iridium chloride and ammonium hexachloroiridium(III) acid are preferably used in combination to obtain a high sensitivity and a high contrast.

The silver halide emulsion layer for use in the present invention may contain spectral sensitizing dyes according to the exposure wavelength.

The sensitizing dyes for use in the present invention include those described in *Research Disclosure*, Item 17643, IV-A (December 1978, p.23); ibid., Item 1831, X (August 1978, p.437) and the references cited therein.

In special cases where various type of scanners are used for exposure, it is advantageous to choose sensitizing dyes which can impart spectral sensitivities suited for spectral characteristics of the light source of the scanner used.

The amount of sensitizing dyes added is, though depending on the size of silver halide grains, the halogen composition, the method and degree of the chemical sensitization, the relation of the layer to which the dyes are added and the silver halide emulsion, and the kinds of the antifoggants; however, the amount can be easily selected by one skilled in the art. Generally, the amount is from $1\times10^{-7}$ to $1\times10^{-2}$ mol, preferably from $1\times10^{-6}$ to $5\times10^{-3}$ mol, per mol of silver halide.

Gelatin is preferably used as a protective colloid for a photographic emulsion or a binder for other hydrophilic colloid layer. In addition to the gelatin, other hydrophilic colloids can be used. Examples thereof include gelatin derivatives; graft polymers of gelatin and other high polymers; proteins such as albumin and casein; cellulose derivatives such as hydroxyethyl cellulose, carboxymethyl cellulose, and cellulose sulfate; sodium alginate; sugar derivatives such as starch derivatives; and various kinds of synthetic hydrophilic high polymers of homopolymers or copolymers such as polyvinyl alcohol, polyvinyl alcohol partial acetal, poly-N-vinylpyrolidone, polyacrylic acid, polymethacrylic acid, polyacrylamide, polyvinylimidazole, and polyvinylpyrazol.

The gelatin for use in the present invention may be lime-processed gelatin, acid-processed gelatin, a gelatin hydrolysis product or a gelatin enzyme-decomposed product.

Various compounds can be incorporated into the photographic material of the present invention for the purpose of preventing a fog or stabilizing a photographic performance during manufacturing, storage or a photographic processing of the photographic material. Many compounds known as an antifoggant or a stabilizer may be added into the photographic material. Examples thereof include azoles such as benzothiazolium salts, nitroindazoles, chlorobenzimidazoles, bromobenzimidazoles, mercaprothiadiazoles, aminotriazoles, benzothiazoles, and nitrobenzotriazoles; mercaptopyrimidines; mercaptotriazines; thioketo compounds such as oxazolinethione; azaindenes such as triazaindenes, tetrazaindenes (particularly 4-hydroxy-substituted (1,3,3a,7)tetrazaindenes), and pentazaindenes; hydroquinone, and the derivatives thereof; disulfides such as thioctic acid; benzenethiosulfonic acid, benzenesulfinic acid, and benzenesulfonamide. Among these compounds, preferred are benzotriazoles (for example, 5-methylbenzotriazole) and nitroindazoles (for example, 5-nitroindazole). These compounds may be contained in a processing solution.

The photographic material of the present invention may contain an organic desensitizer. The organic desensitizer has at least one water soluble group or alkali dissocitative group.

These preferred organic desensitizers are exemplified in U.S. Pat. No. 4,908,293. The organic desensitizer is used in an amount of $1.0\times10^{-8}$ to $1.0\times10^{-4}$ mol/m$^2$, preferably from $1.0\times10^{-7}$ to $1.0\times10^{-5}$ mol/m$^2$, in a silver halide emulsion layer.

The photographic material of the present invention may contain a developing accelerator.

Examples of the developing accelerator or an accelerator for a nucleating infectious development for use in the present invention include compounds containing an N or S atom as well as compounds disclosed in JP-A-53-77616, JP-A-54-37732, JP-A-53-137133, JP-A-60-140340 and JP-A-60-14959.

These accelerators have a different optimum addition amount according to the type of the compounds and are preferably used in an amount of from $1.0\times10^{-3}$ to 0.5 g/m$^2$, preferably from $5.0\times10^{-3}$ to 0.1 g/m$^2$. These accelerators are dissolved in a suitable solvent (for example, water, alcohol such as methanol and ethanol, acetone, dimethylformamide, methyl cellosolve) to add them into a coating solution.

These additives may be used in combination of plural kinds.

The emulsion layers and other hydrophilic colloid layers in the photographic material of the present invention may contain dyes as a filter dye or for the various purposes of irradiation prevention and others. Examples of the filter dye include a dye for further lowering a photographic sensitivity, preferably a UV absorber having a spectral absorption maximum in an inherent sensitive region of silver halide and a dye having a substantial light absorption primarily in a region of 310 to 600 nm for rasing a safety against a safelight in handling a daylight photographic material.

These dyes are preferably added to an emulsion layer according to the objects or an upper part of a silver halide emulsion layer, that is, a non-light-sensitive hydrophilic layer farther from a support than the silver halide emulsion layer together with a mordant to fix them. An addition amount of the dye is different according to a molar extinction coefficient, and it is usually added in an amount of $10^{-3}$ g/m$^2$ to 1 g/m$^2$, preferably from 10 mg/m$^2$ to 500 mg/m$^2$.

The above-described dyes can be dissolved or dispersed in a suitable solvent (for example, alcohol (e.g., methanol, ethanol, propanol), acetone, methyl cellosolve, or a mixture thereof) to add them to a coating solution. These dyes may be used in combination of two or more kinds of the dyes.

Examples of these dyes are described in U.S. Pat. No. 4,908,293. In addition, UV absorbers described in U.S. Pat. Nos. 3,533,794, 3,314,794, and 3,352,681, JP-A-46-2784, U.S. Pat. Nos. 3,705,805, 3,707,375, 4,045,229, 3,700,455 and 3,499,762, and German Patent Publication No. 1,547,863 may also be used. Furthermore, pyrazolone oxonol dyes described in U.S. Pat. No. 2,274,782; diarylazo dyes described in U.S. Pat. No. 2,956,879; styryl dyes and butadienyl dyes described in U.S. Pat. Nos. 3,423,207 and 3,384,487; mericyanine dyes described in U.S. Pat. No. 2,527,583; merocyanine dyes and oxonol dyes described in U.S. Pat. Nos. 3,486,897, 3,652,284 and 3,718,472; enaminohemioxonol dyes described in U.S. Pat. No. 3,976,661; and dyes described in British Patent Nos. 584,609 and 1,177,429, JP-A-48-85130, JP-A-49-99620 and JP-A-49-114420 and U.S. Pat. Nos. 2,533,472, 3,148,187, 3,177,078, 3,247,127, 3,540,887, 3,575,704 and 3,653,905 may be also used.

An inorganic or organic hardener may be incorporated into a photographic emulsion layer and the other hydrophilic colloid layers in the photographic material of the present invention. Examples of the hardener include chromium salts (e.g., chromium alum, chromium acetate), aldehydes (e.g., formaldehyde, glyoxal, glutaraldehyde), N-methylol compounds (e.g., dimethylolurea, methyloldimethylhyrantoin), dioxane derivatives (e.g., 2,3-dihydroxydioxane), active vinyl compounds (e.g., 1,3,5-triacryloylhexahydro-s-triazine, 1,3-vinylsulfonyl-2-propanol), active halogen compounds (e.g., 2,4-dichloro-6-hydroxy-s-triazine), mucohalogenic acids (e.g., mucochloric acid, muchophenoxychloric acid), epoxy compounds (e.g., tetramethylene glycol diglycidyl ether), and isocyanate compounds (e.g., hexamethylenediisocyanate). These compounds may be used singly or in combination.

Furthermore, the polymer hardeners described in JP-A-56-66841, British Patent No. 1,322,971 and U.S. Pat. No. 3,671,256 may be also used.

The photographic emulsion layers and other hydrophilic colloid layers in the photographic material of the present invention may contain various surfactants for various purposes such as coating aid, anti-electrification, improvement in sliding performance, emulsification dispersion, anti-sticking, and improvement in the photographic characteristics (e.g., development acceleration, hard gradation, sensitization).

Examples of the surfactant include a nonionic surfactant such as saponin (steroid type), alkylene oxide derivatives (e.g., polyethylene glycol, polyethylene glycol/polypropylene glycol condensation products, polyethylene glycol alkyl ethers, polyethylene glycol alkyl aryl ethers, polyethylene glycol esters, polyethylene glycol sorbitan esters, polyalkylene glycol alkylamines or amides, polyethylene oxide adducts of silicon), glycidol derivatives (e.g., alkyenylsuccinic acid polyglycerides, alkylphenol polyglycerides), fatty acid esters of polyhydric alcohol, and alkyl esters of saccharose; an anionic surfactant having an acid group such as a carboxyl group, a sulfo group, a phospho group, a sulfurate group, and a phosphorate group, such as alkylcarbonates, alkylsufonates, alkylbenzenesulfonates, alkylnaphthalenesulfonates, alkylsulfurates, alkylphosphorates, N-acyl-N-alkyltaurines, sulfosuccinates, sulfoalkyl polyoxyethylenealkylphenyl ethers, and polyoxyethylene alkylphosphorates; and amphoteric surfactant such as amino acids, aminoalkylsulfonic acids, aminoalkylsulfurates or phosphorates, alkylbetains, and amine oxides; and a cationic surfactant such as alkylamine hydrochloric acids, aliphatic or aromatic quaternary ammonium salts, heterocyclic quaternary ammonium salts such as pyridinium and imidazolium, and aliphatic or heterocycle-containing phosphonium or sulfonium salts.

The surfactants particularly preferably used in the present invention are polyalkylene oxides having a molecular weight of 600 or more, described in JP-B-58-9412. Furthermore, a polymer latex such as polyalkyl aryclate can be incorporated for a dimensional stabilization.

The photographic material according to the present invention may contain electroconductive metal oxide. As the electroconductive metal oxide, the oxide containing oxygen default or the oxide containing a small amount of a hetero atom which can form a doner for metal oxide used are preferred because in general they have high electroconductivity. Particularly, the latter oxide is preferably used because it does not give a silver halide emulsion a fog. Examples of the metal oxide include ZnO, $TiO_2$, $SnO_2$, $Al_2O_3$, $In_2O_3$, $SiO_2$, MgO, BaO, $MoO_3$, $V_2O_5$ and combinations thereof. Among these, ZnO, $TiO_2$ and $ZnO_2$ are preferred. Examples of the oxide containing a hetero atom include ZnO containing Al or In, $SnO_2$ containing Sb, Nb or a halogen element, and $TiO_2$ containing Nb or Ta.

The hetero atom is preferably added in an amount of from 0.01 to 30 mol %, more preferably from 0.1 to 10 mol %.

The electroconductive metal oxide particles for use in the present invention preferably have volume resistivity of $10^7$ Ω/cm or less, particularly preferably $10^5$ Ω/cm or less.

These oxides are described in JP-A-56-143431, JP-A-56-120519 and JP-A-58-62647.

Furthermore, as disclosed in JP-B-59-6235, electroconductive layer materials provided by attaching the above metal oxides to other crystal metal oxide particles or fibriform materials (e.g., titanium oxide) may be used.

The particle size thereof is preferably 10 μm or less, more preferably 2 μm or less because of the stability after dispersion. If electroconductive particles of 0.5 μm or less is used to minimize light dispersion, it is preferred because a transparent light-sensitive material can be formed.

If the electroconductive material is needleshaped or fibrous, the length and the diameter thereof is preferably 30 μm or less and 2 μm or less, respectively. More preferably, the length is from 0.5 μm to 25 μm, and the ratio of the length/diameter is 3/1 or more.

In the present invention, these electroconductive oxides are preferably added to an antihalation layer, a backing layer or an undercoating layer.

The photographic materials of the present invention are not particularly restricted as to additives, and so various kinds of additives can be used therein. However, those disclosed in the following patent specifications can be preferably added thereto.

| Item | Reference and Passage therein |
|---|---|
| 1) Spectral sensitizing dyes | Spectral sensitizing dyes disclosed in JP-A-2-12236, from p.8, left lower column, 1.13 to right lower column, 1.4; JP-A-2-103536, from p.16, right lower column, 1.3 to p.17, left lower column, 1.20; and spectral sensitizing dyes disclosed in JP-A-1-112235, JP-A-2-48653, JP-A-2-105135, JP-A-2-124560, JP-A-3-7928, JP-A-3-67242, and JP-A-5-11389. |
| 2) Nucleation accelerators | Compounds represented by formulae (I), (II), (III), (IV), (V) and (VI) disclosed in JP-A-6-82943; compounds represented by formulae (II-m) to (II-p), and Compounds II-1 to II-22, disclosed in JP-A-2-103536, from p.9, right upper column, 1.13, to p.16, left upper column, 1.10; compounds disclosed in JP-A-1-179939. |
| 3) Surfactants and antistatic agents | JP-A-2-12236, p.9, from right upper column, 1.7 to right lower column, 1.7; and JP-A-2-18542, from p.2, left lower column, 1.13 to p.4, right lower column, 1.18. |
| 4) Antifoggants and stabilizers | JP-A-2-103536, from p.17, right lower column, 1.19 to p.18, right upper column, 1.4, and p.18, right lower column, 1.1–5; thiosulfinic acid compounds disclosed in JP-A-1-237538. |
| 5) Polymer latexes | JP-A-2-103536, p.18, left lower column, 1.12–20. |
| 6) Compounds containing an acid group | JP-A-2-103536, from p.8, left lower column, 1.5 to p.19, left upper column, 1.1; and JP-A-2-55349, from p.8, right lower column, 1.13 to left upper column, 1.8. |
| 7) Matting agents, slipping agents, and plasticizers | JP-A-2-103536, p.19, from left upper column, 1.15, to right upper column, 1.15. |
| 8) Hardeners | JP-A-2-103536, p.18, right upper column, 1.5–17. |
| 9) Dyes | JP-A-2-103536, p.17, right lower column, 1.1–18; JP-A-2-39042, from p.4, right upper column, 1.1 to p.6, right upper column, 1.5; and solid dyes disclosed in JP-A-2-294638 and JP-A-5-11382. |
| 10) Binders | JP-A-2-18542, p.3, right lower column, 1.1–20. |
| 11) Black spot (black pepper) inhibitors | Compounds disclosed in U.S. Pat. No. 4,956,257 and JP-A-1-118832. |
| 12) Redox compounds | Compounds represented by formula (I) disclosed in JP-A-2-301743 (especially Compounds 1 to 50); compounds represented by formulae (R-1), (R-2) and (R-3), Compounds 1 to 75, disclosed at p.3–20 in JP-A-3-174143; compounds disclosed in JP-A-5-257239 and JP-A-4-278939. |
| 13) Monomethine compounds | Compounds represented by formula (II) in JP-A-2-287532 (especially Compounds II-1 to II-26). |
| 14) Dihydroxybenzenes | Compounds disclosed in JP-A-3-39948, from p.11, left upper column to p.12, left lower column; and compounds disclosed in EP-A-452772. |

The present invention will now be illustrated in greater detail by reference to the following examples. However, the invention should not be construed as being limited to these examples.

EXAMPLE 1

Production of Silver Halide Photographic Material

Preparation of Emulsion

Emulsion A was prepared in the following manner.

Emulsion A

An aqueous silver nitrate solution and an aqueous halogen salt solution containing potassium bromide, sodium chloride, $K_3IrCl_6$ in an amount corresponding to $3.5\times10^{-7}$ mol, and $K_2Rh(H_2O)Cl_5$ in an amount corresponding to $2.0\times10^{-7}$ mol, each per mol of silver, were added to an aqueous gelatin solution containing sodium chloride and 1,3-dimethyl-2-imidazolidinethione while stirring by a double jet method to prepare silver bromochloride grains having an average grain size of 0.25 μm and a silver chloride content of 70 mol %.

Thereafter, the grains were washed with water by flocculation according to a normal method, then thereto 40 g/mol-Ag of gelatin was added, 7 mg/mol-Ag of sodium benzenethiosulfonate and 2 g/mol-Ag of benzenesulfinate were further added, the pH and the pAg were adjusted to 6.0 and 7.5, respectively, and then 2 mg/mol-Ag of sodium thiosulfate and 4 mg/mol-Ag of chloroauric acid were added to effect chemical sensitization so that an optimum sensitivity could be achieved at 60° C. Thereafter, 150 mg of 4-hydroxy-6-methyl-1,3,3a,7-tetrazaindene was added thereto as a stabilizer and further 100 mg of Proxel was added as an antiseptic. The resulting grains each was a silver bromochloride cubic grain having an average grain size of 0.25 μm and a silver chloride content of 70 mol % (coefficient of fluctuation: 10%).

Preparation of Coated Sample

Samples 101 to 120 were prepared by coating the following coating solutions on a polyethylene terephthalate film support undercoated by a moisture proofing layer containing vinylidene chloride so as to have a layer structure such as UL layer, EM layer, PC layer and OC layer in this order from the support side.

The preparation method of the coating solution for each layer and the coated amount of the solution are described below.

(UL Layer)

A dispersion of polyethylacrylate was added to an aqueous gelatin solution in an amount of 30 wt % based on the gelatin to give a gelatin content of 0.5 g/m$^2$.

(EM Layer)

To the above-described Emulsion A, the following compounds (S-1) and (S-2) were added as sensitizing dyes each in an amount of $5\times10^{-4}$ mol per mol of silver and further thereto, a mercapto compound represented by the following formula (a), a mercapto compound represented by formula (b), a triazine compound represented by formula (c) and 5-chloro-8-hydroxyquinoline were added in an amount of $3\times10^{-4}$ mol, $4\times10^{-4}$ mol, $4\times10^{-4}$ mol and $2\times10^{-3}$ mol, respectively, per mol of silver. Furthermore, onium salt compounds of the present invention and the following comparative compounds were added as shown in Table 1. Still further, 100 mg of hydroquinone was added and sodium N-oleyl-N-methyltaurine was added to give a coated amount of 30 mg/m$^2$. Then, Hydrazine Derivative IV-38 was added to give a coated amount of 10 mg/m$^2$ and subsequently, 200 mg/m$^2$ of a water-soluble latex represented by formula (d), 400 mg/m2 of a polyethylacrylate dispersion, 200 mg/m$^2$ of colloidal silica having an average particle size of 0.02 $\mu$m and 200 mg/m$^2$ of 1,3-divinylsulfonyl-2-propanol as a hardening agent were added. The pH of the solution was adjusted to 5.65 using an acetic acid. The resulting solution was coated to give a coated amount of 3.5 g/m$^2$ in terms of silver.

S-1

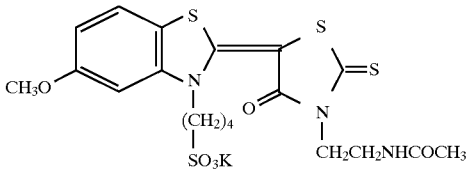

S-2

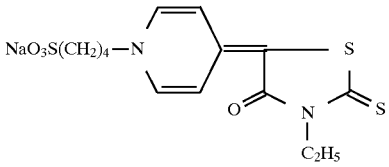

(a)

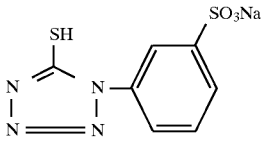

(b)

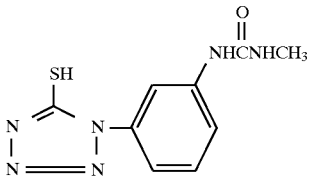

(c)

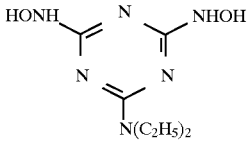

(d)

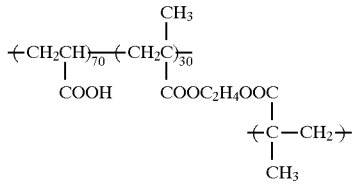

-continued

Comparative Compounds

A-1

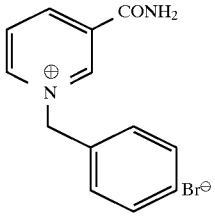

A-2

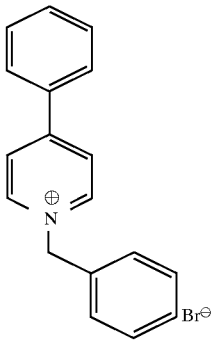

A-3

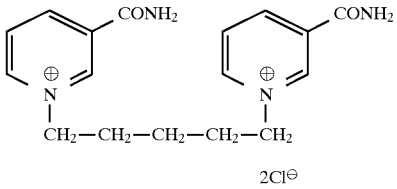

A-4

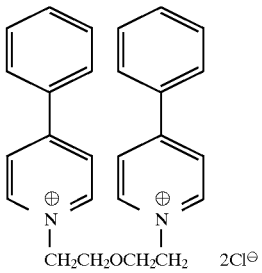

(PC Layer)

An ethylacrylate dispersion was added to an aqueous gelatin solution in an amount of 50 wt % based on the gelatin and also sodium ethylsulfonate and 1,5-dihydroxy-2-benzaldoxime were added to give a coated amount of 5 mg/m$^2$ and 10 mg/m$^2$, respectively. The resulting solution was coated to give a gelatin content of 0.5 g/m$^2$.

(OC Layer)

Gelatin (0.5 g/m$^2$), 40 mg/m$^2$ of an amorphous $SiO_2$ matting agent having an average particle size of about 3.5 $\mu$m, 0.1 g/m$^2$ of methanol silica, 100 mg/m$^2$ of polyacrylamide, 20 mg/m$^2$ of silicone oil and as coating aids, 5 mg/m $^2$ of a fluorine surfactant represented by the following formula (e) and 100 mg/m$^2$ of sodium dodecylbenzenesulfonate were coated.

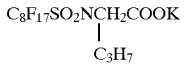

(e)

The resulting coated samples had a back layer and a back protective layer each having the following composition.

Formulation of Back Layer:

| | |
|---|---|
| Gelatin | 3 g/m$^2$ |
| Latex: Polyethylacrylate | 2 g/m$^2$ |
| Surfactant: | |
| Sodium p-dodecylbenzenesulfonate | 40 mg/m$^2$ |
| $CH_2{=}CHSO_2CH_2CONH$ — $(CH_2)_2$ — $CH_2{=}CHSO_2CH_2CONH$ | 110 mg/m$^2$ |
| Dye: a mixture of Dye [a], Dye [b] and Dye [c] | |
| Dye [a] | 70 mg/m$^2$ |
| Dye [b] | 70 mg/m$^2$ |
| Dye [c] | 90 mg/m$^2$ |

Dye [a]

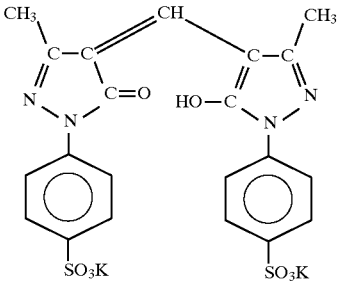

Dye [b]

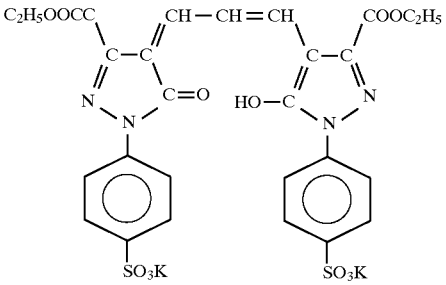

Dye [c]

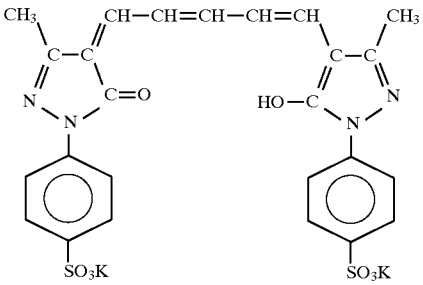

Back Protective Layer:

| | |
|---|---|
| Gelatin | 0.8 mg/m$^2$ |
| Polymethyl methacrylate fine particle (average particle diameter: 4.5 $\mu$m) | 30 mg/m$^2$ |
| Sodium dihexyl-$\alpha$-sulfosuccinate | 15 mg/m$^2$ |
| Sodium p-dodecylbenzenesulfonate | 15 mg/m$^2$ |
| Sodium acetate | 40 mg/m$^2$ |

Evaluation of Photographic Performance (1) Exposure, Development

Each of the samples obtained above was exposed to a xenon flash light having a light emission time of $10^{-5}$ sec through an interference filter having a peak at 488 nm and through a step wedge and then developed with Developer A having the following composition at 30° C. for 30 seconds, followed by fixing, water washing and drying. The fixing solution had the following composition.

Developer A

| | |
|---|---|
| Sodium hydroxide | 35.0 g |
| Diethylenetriaminepentaacetic acid | 2.0 g |
| Potassium carbonate | 12.0 g |
| Sodium metabisulfite | 40.0 g |
| Potassium bromide | 3.0 g |
| Hydroquinone | 25.0 g |
| 5-Methylbenzotriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazoline | 0.04 g |
| Sodium 2-mercaptobenzimidazole-5-sulfonate | 0.15 g |
| Potassium hydroxide and water were added to make 1 l and the pH was adjusted to 10.5. | |

Fixing Solution

| | |
|---|---|
| Ammonium thiosulfate | 359.1 ml |
| Disodium ethyleneaminetetraacetate dihydrate | 2.26 g |
| Sodium thiosulfate pentahydrate | 32.8 g |
| Sodium sulfite | 64.8 g |
| NaOH | 37.2 g |
| Glacial acetic acid | 87.3 g |
| Tartaric acid | 8.76 g |
| Sodium gluconate | 6.6 g |
| Aluminum sulfate | 25.3 g |
| Water to make | 1 l |
| pH (adjusted by sulfuric acid or sodium hydroxide) | 4.85 |

(2) Evaluation on Image Contrast

As an index ($\gamma$) for the image contrast, a gamma value as a gradient of a straight chain drawn by connecting a point to give fog+density of 0.3 and a point to give fog+density of 3.0 in the characteristic curve is used. More specifically, $\gamma$=(3.0−0.3)/[log(exposure amount to give density of 3.0)−log(exposure amount to give density of 0.3)], and the larger the gamma value, the higher contrast the photographic properties.

(3) Evaluation on Dot Quality (DQ)

After the exposure through a contact screen, the dots of the photographic material were observed through a magnifier and the evaluation was made on definition and smoothness by five-stage rating. "5" shows that the definition and the smoothness both are on the highest level and "1" shows that they are on the lowest level. If evaluated as "3" or higher, the definition and the smoothness on the on/off area of an image at a time of real scanner exposure can be deemed fair in practice.

(4) Evaluation on Black Spot (Black Pepper)

After the exposure, each photographic material was developed with Developer A at 35° C. for 90 seconds, fixed, water washed and dried and then, the photographic material was observed through a magnifier to evaluate on the generation level by five-stage rating. "5" shows the level thoroughly free of generation of black spots and "1" shows the lowest level. The evaluation of "3" or higher lies on a practically fair level.

(5) Evaluation on Sensitivity

The sensitivity was shown by a relative value of a reciprocal of the exposure amount giving a density of 1.5. The sensitivity of a sample for Sample 105 was taken as 100.

The results obtained are shown in Table 1.

TABLE 1

| No. | Sample No. | Compound No. | Addition Amount (mol/m$^2$) | Sensitivity | Gradation (γ) | DQ | Black Spot | Remarks |
|---|---|---|---|---|---|---|---|---|
| 1 | 101 | A-1 | $5.0 \times 10^{-5}$ | 85 | 9.3 | 3 | 4 | Comparison |
| 2 | 102 | A-2 | $5.0 \times 10^{-5}$ | 92 | 10.9 | 2 | 3 | Comparison |
| 3 | 102 | A-3 | $2.5 \times 10^{-5}$ | 93 | 11.3 | 2 | 3 | Comparison |
| 4 | 104 | A-4 | $2.5 \times 10^{-5}$ | 91 | 10.4 | 2 | 4 | Comparison |
| 5 | 105 | I-1 | $2.5 \times 10^{-5}$ | 100 | 15.3 | 4 | 4 | Invention |
| 6 | 106 | I-2 | $5.0 \times 10^{-5}$ | 106 | 19.4 | 5 | 5 | Invention |
| 7 | 107 | I-9 | $2.5 \times 10^{-5}$ | 104 | 18.9 | 5 | 5 | Invention |
| 8 | 108 | I-10 | $2.5 \times 10^{-5}$ | 107 | 20.2 | 3 | 4 | Invention |
| 9 | 109 | I-13 | $5.0 \times 10^{-5}$ | 106 | 19.3 | 4 | 5 | Invention |
| 10 | 110 | I-21 | $5.0 \times 10^{-5}$ | 107 | 20.0 | 5 | 5 | Invention |
| 11 | 111 | I-23 | $5.0 \times 10^{-5}$ | 104 | 18.4 | 5 | 4 | Invention |
| 12 | 112 | I-26 | $5.0 \times 10^{-5}$ | 103 | 17.9 | 4 | 4 | Invention |
| 13 | 113 | I-27 | $2.5 \times 10^{-5}$ | 105 | 19.5 | 4 | 5 | Invention |
| 14 | 114 | I-29 | $2.5 \times 10^{-5}$ | 102 | 17.3 | 5 | 4 | Invention |
| 15 | 115 | I-30 | $5.0 \times 10^{-5}$ | 108 | 20.4 | 5 | 5 | Invention |
| 16 | 116 | I-39 | $2.5 \times 10^{-5}$ | 110 | 22.0 | 5 | 5 | Invention |
| 17 | 117 | I-41 | $2.5 \times 10^{-5}$ | 102 | 16.9 | 4 | 4 | Invention |
| 18 | 118 | I-45 | $2.5 \times 10^{-5}$ | 103 | 18.7 | 4 | 5 | Invention |
| 19 | 119 | I-47 | $2.5 \times 10^{-5}$ | 105 | 19.3 | 4 | 4 | Invention |
| 20 | 120 | I-49 | $5.0 \times 10^{-5}$ | 102 | 17.9 | 5 | 4 | Invention |

As is seen in Table 1, by the combination use of a hydrazine compound with the onium compound of the present invention, good photographic properties were achieved as compared with the combination use thereof with a conventional compound.

EXAMPLE 2

Samples 101 to 120 were evaluated in the same manner as in Example 1 except that Developer A used in Example 1 was replaced by Developer B having the following composition and then, good results were obtained the same as in Example 1.

| Developer B: | |
|---|---|
| Sodium hydroxide | 10.0 g |
| Diethylenetriaminepentaacetic acid | 1.5 g |
| Potassium carbonate | 15.0 g |
| Potassium bromide | 3.0 g |
| 5-Methylbenzotriazole | 0.10 g |
| 1-Phenyl-5-mercaptotetrazole | 0.02 g |
| Potassium sulfite | 10.0 g |
| 4-Hydroxymethyl-4-methyl-1-phenyl-3-pyrazolidone | 0.40 g |
| Sodium erysorbate | 30.0 g |
| Potassium hydroxide and water were added to make 1 l and the pH was adjusted to 10.5. | |

EXAMPLE 3

Production of Silver Halide Photographic Material

Samples 201 to 220 were prepared in the same manner as in Example 1 except that Hydrazine Derivative IV-38 was excluded from the photographic material.

Evaluation of Photographic Performance

The evaluation was conducted in the same manner as in Example 1 except that Developer B and Developer C having the following formulation were used in place of Developer A used in Example 1.

| Developer C (Comparison) | |
|---|---|
| Sodium hydroxide | 10.0 g |
| Diethylenetriaminepentaacetic acid | 1.5 g |
| Potassium carbonate | 15.0 g |
| Potassium bromide | 3.0 g |
| 5-Methylbenzotriazole | 0.10 g |
| 1-Phenyl-5-mercaptotetrazole | 0.02 g |
| Potassium sulfite | 10.0 g |
| 4-Hydroxymethyl-4-methyl-1-phenyl-3-pyrazolidone | 0.40 g |
| Hydroquinone | 15.3 g |
| Potassium hydroxide and water were added to make 1 l and the pH was adjusted to 10.5. | |

The image contrast and the dot quality (DQ) were evaluated in the same manner as in Example 1. The results obtained are shown in Table 2.

TABLE 2

| No. | Sample No. | Compound No. | Addition Amount (mol/m$^2$) | Sensitivity | Gradation (γ) | DQ | Black Spot | Developer | Remarks |
|---|---|---|---|---|---|---|---|---|---|
| 1 | 201 | A-1 | $5.0 \times 10^{-5}$ | 85 | 9.3 | 3 | 4 | B | Comparison |
| 2 | 202 | A-2 | $5.0 \times 10^{-5}$ | 92 | 10.9 | 2 | 3 | B | Comparison |
| 3 | 202 | A-3 | $2.5 \times 10^{-5}$ | 91 | 11.3 | 2 | 3 | B | Comparison |
| 4 | 204 | A-4 | $2.5 \times 10^{-5}$ | 85 | 10.4 | 2 | 4 | B | Comparison |
| 5 | 205 | I-1 | $2.5 \times 10^{-5}$ | 100 | 15.3 | 4 | 4 | B | Invention |
| 6 | 206 | I-2 | $5.0 \times 10^{-5}$ | 106 | 19.4 | 5 | 5 | B | Invention |
| 7 | 207 | I-9 | $2.5 \times 10^{-5}$ | 104 | 18.9 | 5 | 5 | B | Invention |
| 8 | 208 | I-10 | $2.5 \times 10^{-5}$ | 107 | 20.2 | 3 | 4 | B | Invention |

TABLE 2-continued

| No. | Sample No. | Compound No. | Addition Amount (mol/m$^2$) | Sensitivity | Gradation (γ) | DQ | Black Spot | Developer | Remarks |
|---|---|---|---|---|---|---|---|---|---|
| 9 | 209 | I-13 | $5.0 \times 10^{-5}$ | 106 | 19.3 | 4 | 5 | B | Invention |
| 10 | 210 | I-21 | $5.0 \times 10^{-5}$ | 107 | 20.0 | 5 | 5 | B | Invention |
| 11 | 211 | I-23 | $5.0 \times 10^{-5}$ | 104 | 18.4 | 5 | 4 | B | Invention |
| 12 | 212 | I-26 | $5.0 \times 10^{-5}$ | 103 | 17.9 | 4 | 4 | B | Invention |
| 13 | 213 | I-27 | $2.5 \times 10^{-5}$ | 105 | 19.5 | 4 | 5 | B | Invention |
| 14 | 214 | I-29 | $2.5 \times 10^{-5}$ | 102 | 17.3 | 5 | 4 | B | Invention |
| 15 | 215 | I-30 | $5.0 \times 10^{-5}$ | 108 | 20.4 | 5 | 5 | B | Invention |
| 16 | 216 | I-39 | $2.5 \times 10^{-5}$ | 110 | 22.0 | 5 | 5 | B | Invention |
| 17 | 217 | I-41 | $2.5 \times 10^{-5}$ | 102 | 16.9 | 4 | 4 | B | Invention |
| 18 | 218 | I-45 | $2.5 \times 10^{-5}$ | 103 | 18.7 | 4 | 5 | B | Invention |
| 19 | 219 | I-47 | $2.5 \times 10^{-5}$ | 105 | 19.3 | 4 | 4 | B | Invention |
| 20 | 220 | I-49 | $5.0 \times 10^{-5}$ | 102 | 17.9 | 5 | 4 | B | Invention |
| 21 | 201 | A-1 | $5.0 \times 10^{-5}$ | 85 | 9.3 | 3 | 4 | C | Comparison |
| 22 | 202 | A-2 | $5.0 \times 10^{-5}$ | 92 | 10.9 | 2 | 3 | C | Comparison |
| 23 | 202 | A-3 | $2.5 \times 10^{-5}$ | 93 | 11.3 | 2 | 3 | C | Comparison |
| 24 | 204 | A-4 | $2.5 \times 10^{-5}$ | 91 | 10.4 | 2 | 2 | C | Comparison |
| 25 | 205 | I-1 | $2.5 \times 10^{-5}$ | 91 | 11.3 | 2 | 2 | C | Comparison |
| 26 | 206 | I-2 | $5.0 \times 10^{-5}$ | 86 | 13.4 | 3 | 3 | C | Comparison |
| 27 | 207 | I-9 | $2.5 \times 10^{-5}$ | 85 | 14.9 | 3 | 3 | C | Comparison |
| 28 | 208 | I-10 | $2.5 \times 10^{-5}$ | 94 | 11.2 | 2 | 2 | C | Comparison |
| 29 | 209 | I-13 | $5.0 \times 10^{-5}$ | 89 | 12.3 | 3 | 3 | C | Comparison |
| 30 | 210 | I-21 | $5.0 \times 10^{-5}$ | 87 | 15.0 | 2 | 3 | C | Comparison |
| 31 | 211 | I-23 | $5.0 \times 10^{-5}$ | 86 | 11.4 | 2 | 3 | C | Comparison |
| 32 | 212 | I-26 | $5.0 \times 10^{-5}$ | 92 | 11.9 | 3 | 2 | C | Comparison |
| 33 | 213 | I-27 | $2.5 \times 10^{-5}$ | 96 | 12.5 | 2 | 3 | C | Coiuparison |
| 34 | 214 | I-29 | $2.5 \times 10^{-5}$ | 95 | 11.3 | 2 | 3 | C | Comparison |
| 35 | 215 | I-30 | $5.0 \times 10^{-5}$ | 96 | 12.4 | 2 | 5 | C | Comparison |
| 36 | 216 | I-39 | $2.5 \times 10^{-5}$ | 86 | 13.0 | 2 | 3 | C | Comparison |
| 37 | 217 | I-41 | $2.5 \times 10^{-5}$ | 93 | 11.9 | 3 | 3 | C | Comparison |
| 38 | 218 | I-45 | $2.5 \times 10^{-5}$ | 92 | 13.7 | 3 | 2 | C | Comparison |
| 39 | 219 | I-47 | $2.5 \times 10^{-5}$ | 95 | 12.3 | 3 | 3 | C | Comparison |
| 40 | 220 | I-49 | $5.0 \times 10^{-5}$ | 87 | 12.9 | 3 | 2 | C | Comparison |

As is seen from Table 2, good photographic properties were achieved by the combination of the compound of the present invention with the developer of the present invention. Even if the developer of the present invention was used, when it was combined with the comparative compound, good photographic properties could not be achieved.

EXAMPLE 4

Production of Silver Halide Photographic Material

Preparation of Emulsion

Emulsion B was prepared by the following method.

Emulsion B

An aqueous silver nitrate solution and an aqueous sodium chloride solution were mixed to an aqueous gelatin solution kept at 40° C. by a double jet method in the presence of $5.0\times10^{-6}$ mol/mol-Ag of $NH_4RhCl_6$, then soluble salts were removed by a method well known in the art, gelatin was added thereto and without passing through chemical sensitization, 2-methyl-4-hydroxy-1,3,3a,7-tetrazaindene as a stabilizer was added. The resulting emulsion was a monodisperse emulsion in the cubic crystal form having an average grain size of 0.2 μm.

Preparation of Coated Sample

Samples 301 to 320 were prepared by coating the following coating solutions on a polyethylene terephthalate film support undercoated by a moisture proofing layer containing vinylidene chloride so as to have a layer structure such as EM layer and PC layer in this order from the support side.

The preparation and the coating amount of each layer are shown below.

(EM Layer)

The onium salt compounds of the present invention and the comparative compounds were added to Emulsion B obtained above as shown in Table 3 and Table 4. Then, Hydrazine Derivative IV-33 was added thereto in an amount of 20 mg/m$^2$.

Further, a polyethylene acrylate latex was added in an amount of 30 wt % as a solid content based on gelatin and 1,3-divinylsulfonyl-2-propanol as a hardening agent was added. The resulting solution was coated on a polyester support to give an Ag amount of 3.8 g/m$^2$. The gelatin content was 1.8 g/m$^2$.

(PC Layer)

A layer containing 1.5 g/m$^2$ of gelatin and 0.3 g/m$^2$ of polymethyl methacrylate having a particle size of 2.5 μm was coated.

The base used in this example had a backing layer and a backing protective layer each having the following composition. The swelling rate on the backing side was 110%.

| Formulation of Backing Layer: | |
|---|---|
| Gelatin | 170 mg/m$^2$ |
| Sodium dodecylbenzenesulfonate | 32 mg/m$^2$ |
| Sodium dihexyl-α-sulfosuccinate | 35 mg/m$^2$ |
| Backing Protective Layer: | |
| Gelatin | 2.8 g/m$^2$ |
| Silicon dioxide matting agent (average particle diameter: 3.5 μm) | 26 mg/m$^2$ |
| Sodium dihexyl-α-sulfosuccinate | 20 mg/m$^2$ |
| Sodium dodecylbenzenesulfonate | 67 mg/m$^2$ |
| $C_8F_{17}SO_2N(C_3H_7)-(CH_2CH_2O)_n-(CH_2)_4-SO_3Li$ | 5 mg/m$^2$ |

-continued

Dye A: 190 mg/m$^2$

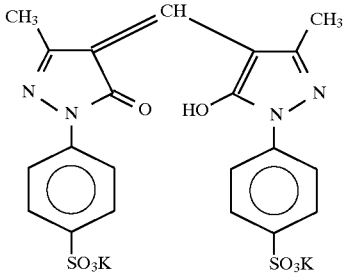

Dye B: 32 mg/m$^2$

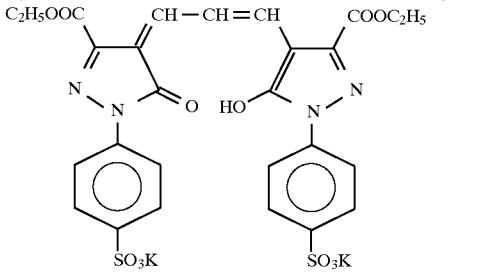

Dye C: 59 mg/m$^2$

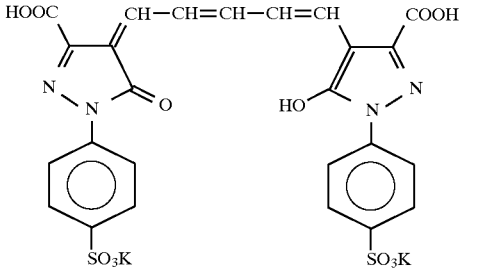

Ethylacrylate latex (average particle size: 0.05 $\mu$m) 260 mg/m$^2$

-continued

| | |
|---|---|
| 1,3-Divinylsulfonyl-2-propanol | 149 mg/m$^2$ |

Evaluation of Photographic Performance (1) Exposure, Development

Each of the samples obtained above was exposed through a step wedge by means of a daylight printer P-627 FM, manufactured by Dai-Nippon Screen Mfg. Co., Ltd., and developed with Developer A described in Example 1 at 38° C. for 20 seconds in an automatic developing machine, FG710NH, manufactured by Fuji Photo Film Co., Ltd., followed by fixing with the fixing solution described in Example 1, water washing and drying.

(2) Evaluation on Sensitivity, DQ and Image Contrast

The evaluation was conducted in the same manner as in Example 1.

(3) Evaluation on Super-Imposed Letter Image Quality

The super-imposed letter image quality of 5 means a very good super-imposed letter image quality where when an optimum exposure is effected using an original shown in FIG. 1 so that the 50% dot area could be reflected by 50% dot area on the photographic material for dot-to-dot working, a letter in a width of 30 $\mu$m is reproduced. On the other hand, the super-imposed letter image quality of 1 means a poor image quality where on an optimum exposure as described above, a letter in a width of 150 $\mu$m or more only can be reproduced. Between rank 1 and rank 5, ranks 2 to 4 were provided according to sensory evaluation. Samples in rank 3 or higher lie on a level capable of practical use. The results obtained are shown in Table 3.

TABLE 3

| No. | Sample No. | Compound No. | Addition Amount (mol/m$^2$) | Sensitivity | Gradation (γ) | DQ | Super-Imposed Letter Image Quality | Remarks |
|---|---|---|---|---|---|---|---|---|
| 1 | 301 | A-1 | $5.0 \times 10^{-5}$ | 87 | 10.2 | 3 | 3 | Comparison |
| 2 | 302 | A-2 | $5.0 \times 10^{-5}$ | 91 | 11.6 | 2 | 2 | Comparison |
| 3 | 302 | A-3 | $2.5 \times 10^{-5}$ | 92 | 12.4 | 3 | 2 | Comparison |
| 4 | 304 | A-4 | $2.5 \times 10^{-5}$ | 99 | 15.2 | 2 | 4 | Comparison |
| 5 | 305 | I-1 | $2.5 \times 10^{-5}$ | 100 | 16.4 | 4 | 4 | Invention |
| 6 | 306 | I-2 | $5.0 \times 10^{-5}$ | 108 | 18.7 | 4 | 4 | Invention |
| 7 | 307 | I-9 | $2.5 \times 10^{-5}$ | 106 | 19.3 | 4 | 5 | Invention |
| 8 | 308 | I-10 | $2.5 \times 10^{-5}$ | 108 | 21.4 | 3 | 4 | Invention |
| 9 | 309 | I-13 | $5.0 \times 10^{-5}$ | 105 | 19.0 | 4 | 4 | Invention |
| 10 | 310 | I-21 | $5.0 \times 10^{-5}$ | 106 | 20.4 | 4 | 5 | Invention |
| 11 | 311 | I-23 | $5.0 \times 10^{-5}$ | 106 | 19.4 | 3 | 4 | Invention |
| 12 | 312 | I-26 | $5.0 \times 10^{-5}$ | 103 | 16.9 | 4 | 5 | Invention |
| 13 | 313 | I-27 | $2.5 \times 10^{-5}$ | 105 | 19.8 | 4 | 5 | Invention |
| 14 | 314 | I-29 | $2.5 \times 10^{-5}$ | 102 | 18.3 | 4 | 4 | Invention |
| 15 | 315 | I-30 | $5.0 \times 10^{-5}$ | 108 | 21.4 | 5 | 5 | Invention |
| 16 | 316 | I-39 | $2.5 \times 10^{-5}$ | 110 | 21.3 | 5 | 4 | Invention |
| 17 | 317 | I-41 | $2.5 \times 10^{-5}$ | 102 | 17.9 | 4 | 4 | Invention |
| 18 | 318 | I-45 | $2.5 \times 10^{-5}$ | 103 | 18.2 | 4 | 5 | Invention |
| 19 | 319 | I-47 | $2.5 \times 10^{-5}$ | 105 | 19.6 | 5 | 4 | Invention |
| 20 | 320 | I-49 | $5.0 \times 10^{-5}$ | 102 | 17.9 | 4 | 4 | Invention |

As is seen from Table 3, by the combination use of a hydrazine compound with the compound of the present invention, good photographic properties were achieved as compared with the combination use thereof with a conventional compound.

EXAMPLE 5

Samples 301 to 320 were evaluated in the same manner as in Example 4 except that Developer A used in Example 4 was replaced by Developer B and then, good results were obtained the same as in Example 1.

EXAMPLE 6

Production of Silver Halide Photographic Material

Samples 401 to 420 were prepared in the same manner as in Example 4 except that Hydrazine Derivative IV-33 was excluded from the photographic material.

Evaluation on Photographic Properties

The evaluation was conducted in the same manner as in Example 4 except for using the above-described Developer B and Developer C in place of Developer A used in Example 3. The results are shown in Table 4.

TABLE 4

| No. | Sample No. | Compound No. | Addition Amount (mol/m$^2$) | Sensitivity | Gradation (γ) | DQ | Super-Imposed Letter Image Quality | Developer | Remarks |
|---|---|---|---|---|---|---|---|---|---|
| 1 | 401 | A-1 | $5.0 \times 10^{-5}$ | 87 | 10.1 | 3 | 2 | B | Comparison |
| 2 | 402 | A-2 | $5.0 \times 10^{-5}$ | 91 | 10.6 | 2 | 1 | B | Comparison |
| 3 | 402 | A-3 | $2.5 \times 10^{-5}$ | 92 | 11.4 | 3 | 1 | B | Comparison |
| 4 | 404 | A-4 | $2.5 \times 10^{-5}$ | 99 | 12.2 | 2 | 3 | B | Comparison |
| 5 | 405 | I-1 | $2.5 \times 10^{-5}$ | 100 | 14.4 | 4 | 3 | B | Invention |
| 6 | 406 | I-2 | $5.0 \times 10^{-5}$ | 106 | 15.7 | 4 | 4 | B | Invention |
| 7 | 407 | I-9 | $2.5 \times 10^{-5}$ | 104 | 15.3 | 4 | 4 | B | Invention |
| 8 | 408 | I-10 | $2.5 \times 10^{-5}$ | 106 | 20.4 | 3 | 3 | B | Invention |
| 9 | 409 | I-13 | $5.0 \times 10^{-5}$ | 104 | 17.0 | 4 | 3 | B | Invention |
| 10 | 410 | I-21 | $5.0 \times 10^{-5}$ | 105 | 17.4 | 4 | 5 | B | Invention |
| 11 | 411 | I-23 | $5.0 \times 10^{-5}$ | 105 | 15.4 | 3 | 3 | B | Invention |
| 12 | 412 | I-26 | $5.0 \times 10^{-5}$ | 102 | 17.9 | 4 | 4 | B | Invention |
| 13 | 413 | I-27 | $2.5 \times 10^{-5}$ | 104 | 18.8 | 4 | 4 | B | Invention |
| 14 | 414 | I-29 | $2.5 \times 10^{-5}$ | 101 | 17.3 | 4 | 5 | B | Invention |
| 15 | 415 | I-30 | $5.0 \times 10^{-5}$ | 107 | 20.4 | 5 | 3 | B | Invention |
| 16 | 416 | I-39 | $2.5 \times 10^{-5}$ | 107 | 20.1 | 5 | 3 | B | Invention |
| 17 | 417 | I-41 | $2.5 \times 10^{-5}$ | 101 | 17.0 | 4 | 4 | B | Invention |
| 18 | 418 | I-45 | $2.5 \times 10^{-5}$ | 103 | 16.2 | 4 | 4 | B | Invention |
| 19 | 419 | I-47 | $2.5 \times 10^{-5}$ | 104 | 17.6 | 5 | 3 | B | Invention |
| 20 | 420 | I-49 | $5.0 \times 10^{-5}$ | 101 | 17.1 | 4 | 3 | B | Invention |
| 21 | 401 | A-1 | $5.0 \times 10^{-5}$ | 87 | 10.1 | 3 | 2 | C | Comparison |
| 22 | 402 | A-2 | $5.0 \times 10^{-5}$ | 91 | 10.6 | 2 | 1 | C | Comparison |
| 23 | 402 | A-3 | $2.5 \times 10^{-5}$ | 92 | 11.4 | 3 | 1 | C | Comparison |
| 24 | 404 | A-4 | $2.5 \times 10^{-5}$ | 99 | 12.2 | 2 | 2 | C | Comparison |
| 25 | 405 | I-1 | $2.5 \times 10^{-5}$ | 88 | 12.4 | 3 | 2 | C | Comparison |
| 26 | 406 | I-2 | $5.0 \times 10^{-5}$ | 89 | 13.7 | 3 | 3 | C | Comparison |
| 27 | 407 | I-9 | $2.5 \times 10^{-5}$ | 91 | 11.3 | 3 | 1 | C | Comparison |
| 28 | 408 | I-10 | $2.5 \times 10^{-5}$ | 96 | 13.4 | 3 | 2 | C | Comparison |
| 29 | 409 | I-13 | $5.0 \times 10^{-5}$ | 89 | 12.0 | 2 | 2 | C | Comparison |
| 30 | 410 | I-21 | $5.0 \times 10^{-5}$ | 88 | 11.4 | 3 | 3 | C | Comparison |
| 31 | 411 | I-23 | $5.0 \times 10^{-5}$ | 93 | 11.4 | 3 | 2 | C | Comparison |
| 32 | 412 | I-26 | $5.0 \times 10^{-5}$ | 87 | 12.9 | 2 | 2 | C | Comparison |
| 33 | 413 | I-27 | $2.5 \times 10^{-5}$ | 91 | 13.8 | 3 | 3 | C | Comparison |
| 34 | 414 | I-29 | $2.5 \times 10^{-5}$ | 86 | 11.3 | 3 | 1 | C | Comparison |
| 35 | 415 | I-30 | $5.0 \times 10^{-5}$ | 93 | 12.4 | 3 | 2 | C | Comparison |
| 36 | 416 | I-39 | $2.5 \times 10^{-5}$ | 89 | 10.1 | 3 | 2 | C | Comparison |
| 37 | 417 | I-41 | $2.5 \times 10^{-5}$ | 95 | 10.0 | 3 | 3 | C | Comparison |
| 38 | 418 | I-45 | $2.5 \times 10^{-5}$ | 94 | 12.2 | 2 | 3 | C | Comparison |
| 39 | 419 | I-47 | $2.5 \times 10^{-5}$ | 96 | 11.6 | 2 | 2 | C | Comparison |
| 40 | 420 | I-49 | $5.0 \times 10^{-5}$ | 97 | 11.1 | 3 | 3 | C | Comparison |

As is seen from Table 4, good photographic properties were achieved by the combination of the compound of the present invention with the developer of the present invention. Even if the developer of the present invention was used, when it was combined with the comparative compound, good photographic properties could not be achieved.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, and a compound represented by the following formula (I) or (II):

$$A\text{-}((L)_m\text{—}B)_n \quad (I)$$

$$(A\text{—}(L)_m)_n\text{-}B \quad (II)$$

wherein A represents an adsorption accelerating group to silver halide or a precursor thereof;

B represents a quaternised nitrogen-containing heterocyclic ring and a counter ion thereof, provided that when an alkyl group is bonded to the nitrogen atom of the nitrogen-containing heterocyclic ring to form the quaternary salt or when an alkyl group is bonded to a carbon atom adjacent to the nitrogen atom, said alkyl group does not have an alkynyl group at the alpha-position or a carbonyl group, a hydrazino group or an imino group at the beta-position;

L represents a linking group;

m represents O or 1; and n represents an integer of from 1 to 4.

2. The silver halide photographic material as claimed in claim 1, which further contains a hydrazine derivative.

* * * * *